US010894404B2

(12) United States Patent
Yamada et al.

(10) Patent No.: US 10,894,404 B2
(45) Date of Patent: Jan. 19, 2021

(54) PRINT HEAD CONTROL CIRCUIT AND LIQUID DISCHARGE APPARATUS

(71) Applicant: SEIKO EPSON CORPORATION, Tokyo (JP)

(72) Inventors: Tomonori Yamada, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/572,878

(22) Filed: Sep. 17, 2019

(65) Prior Publication Data

US 2020/0086637 A1 Mar. 19, 2020

(30) Foreign Application Priority Data

Sep. 19, 2018 (JP) ..... 2018-174366
Feb. 28, 2019 (JP) ..... 2019-036734

(51) Int. Cl.
*B41J 2/045* (2006.01)

(52) U.S. Cl.
CPC ..... *B41J 2/04541* (2013.01); *B41J 2/0451* (2013.01); *B41J 2/04548* (2013.01); *B41J 2/04563* (2013.01)

(58) Field of Classification Search
CPC .. B41J 2/04541; B41J 2/0451; B41J 2/04563; B41J 2/04548; B41J 2002/14354; B41J 2/04588; B41J 2/04593; B41J 2/04581; B41J 2/04501; B41J 2/01
See application file for complete search history.

(56) References Cited

U.S. PATENT DOCUMENTS

2014/0247299 A1 9/2014 Kameyama et al.
2017/0173950 A1 6/2017 Hayashi
2019/0009531 A1* 1/2019 Furukawa ..... B41J 2/04596

FOREIGN PATENT DOCUMENTS

JP 09-011457 A 1/1997
JP 2000-190488 A 7/2000
JP 2017-114020 A 6/2017

* cited by examiner

*Primary Examiner* — Bradley W Thies
(74) *Attorney, Agent, or Firm* — Global IP Counselors, LLP

(57) ABSTRACT

In a print head control circuit, a first diagnostic signal wiring group includes first diagnostic signal propagation wiring that propagates a first diagnostic signal, and second diagnostic signal propagation wiring that propagates a second diagnostic signal, the first drive signal wiring group and the second drive signal wiring group propagate a first drive signal and a second drive signal that cause liquid to be discharged, in a first cable, the first diagnostic signal wiring group is provided between the first drive signal wiring group and the second drive signal wiring group.

24 Claims, 18 Drawing Sheets

| NCHG | | L | | | | H |
|---|---|---|---|---|---|---|
| [SIH, SIL] | | [1, 1] LARGE DOT | [1, 0] MEDIUM DOT | [0, 1] SMALL DOT | [0, 0] NON-RECORDING | - |
| S1 | T1 | H | H | L | L | H |
| | T2 | H | L | L | L | |
| S2 | T3 | L | L | L | H | L |
| | T4 | L | H | H | L | |

FIG. 18

| | WIRING NUMBER | CONTACT PORTION | PROPAGATION SIGNAL |
|---|---|---|---|
| 93 | 197a-1 | 180a-1 | CGND3 |
| 83 | 197a-2 | 180a-2 | COMB3 |
| | 197a-3 | 180a-3 | CGND2 |
| 97 | 197a-4 | 180a-4 | COMA2 |
| | 197a-5 | 180a-5 | CGND1 |
| | 197a-6 | 180a-6 | COMB1 |
| 92 | 197a-7 | 180a-7 | GND |
| 82 | 197a-8 | 180a-8 | SI-2 |
| | 197a-9 | 180a-9 | GND |
| | 197a-10 | 180a-10 | SI-3 |
| | 197a-11 | 180a-11 | GND |
| | 197a-12 | 180a-12 | GND |
| | 197a-13 | 180a-13 | GND |
| | 197a-14 | 180a-14 | SI-1 AND DIG3 |
| | 197a-15 | 180a-15 | GND |
| | 197a-16 | 180a-16 | TH |
| | 197a-17 | 180a-17 | CH1 AND DIG2 |
| | 197a-18 | 180a-18 | GND |
| | 197a-19 | 180a-19 | CH2 |
| | 197a-20 | 180a-20 | GND |
| | 197a-21 | 180a-21 | LAT AND DIG1 |
| | 197a-22 | 180a-22 | GND |
| | 197a-23 | 180a-23 | VHV |
| 91 | 197a-24 | 180a-24 | CGND1 |
| 81 | 197a-25 | 180a-25 | COMA1 |
| | 197a-26 | 180a-26 | CGND2 |
| | 197a-27 | 180a-27 | COMB2 |
| | 197a-28 | 180a-28 | CGND3 |
| | 197a-29 | 180a-29 | COMA3 |

FIG. 19

| WIRING NUMBER | CONTACT PORTION | PROPAGATION SIGNAL |
|---|---|---|
| 197b-1 | 180b-1 | CGND4 |
| 197b-2 | 180b-2 | COMB4 |
| 197b-3 | 180b-3 | CGND5 |
| 197b-4 | 180b-4 | COMA5 |
| 197b-5 | 180b-5 | CGND6 |
| 197b-6 | 180b-6 | COMB6 |
| 197b-7 | 180b-7 | GND |
| 197b-8 | 180b-8 | SI-4 |
| 197b-9 | 180b-9 | GND |
| 197b-10 | 180b-10 | SCK AND DIG4 |
| 197b-11 | 180b-11 | GND |
| 197b-12 | 180b-12 | NCHG |
| 197b-13 | 180b-13 | VDD1 |
| 197b-14 | 180b-14 | GND |
| 197b-15 | 180b-15 | GND |
| 197b-16 | 180b-16 | XHOT AND DIG5 |
| 197b-17 | 180b-17 | SI-5 |
| 197b-18 | 180b-18 | GND |
| 197b-19 | 180b-19 | GND |
| 197b-20 | 180b-20 | GND |
| 197b-21 | 180b-21 | SI-6 |
| 197b-22 | 180b-22 | GND |
| 197b-23 | 180b-23 | VDD2 |
| 197b-24 | 180b-24 | CGND6 |
| 197b-25 | 180b-25 | COMA6 |
| 197b-26 | 180b-26 | CGND5 |
| 197b-27 | 180b-27 | COMB5 |
| 197b-28 | 180b-28 | CGND4 |
| 197b-29 | 180b-29 | COMA4 |

96
86
98
95
85
94
84

PRINT HEAD CONTROL CIRCUIT AND LIQUID DISCHARGE APPARATUS

The present application is based on, and claims priority from JP Application Serial Number 2018-174366, filed Sep. 19, 2018 and JP Application Serial Number 2019-036734, filed Feb. 28, 2019, the disclosures of which are hereby incorporated by reference herein in their entirety.

BACKGROUND

1. Technical Field

The present disclosure relates to a print head control circuit and a liquid discharge apparatus.

2. Related Art

A liquid discharge apparatus such as an ink jet printer discharges a liquid such as ink filled in a cavity from a nozzle by driving a piezoelectric element provided on a print head by a drive signal, and forms characters and images on a recording medium. In such a liquid discharge apparatus, when a problem occurs in the print head, there is a possibility that discharge abnormality in which the liquid cannot be normally discharged from the nozzle may occur. When such a discharge abnormality occurs, there is a possibility that discharge accuracy of the ink discharged from the nozzle may be reduced, and the quality of the image formed on the recording medium may be reduced.

JP-A-2017-114020 discloses a print head having a self-diagnosis function that determines by the print head itself whether it is possible to form dots satisfying normal print quality in accordance with a plurality of signals input to the print head.

In addition, JP-A-09-011457 discloses a technique for performing multi-tone printing by discharging different amounts of liquid from a nozzle by propagating a plurality of drive signals to the print head and selectively supplying the plurality of drive signals to the piezoelectric element.

However, in the technique described in JP-A-2017-114020, a plurality of signal lines used for self-diagnosis of the print head are distributed in a cable and a connector. Therefore, when the print head described in JP-A-2017-114020 is applied to the print head that performs multi-tone expression by the plurality of drive signals described in JP-A-09-011457, there is a possibility that the plurality of drive signals propagated as a high voltage signal may interfere with the plurality of signals used for the self-diagnosis of the print head, and the self-diagnosis function of the print head may not normally operate.

SUMMARY

According to an aspect of the present disclosure, there is provided a print head control circuit controlling an operation of a print head having a function of performing self-diagnosis in accordance with signals input from a first coupling point, a second coupling point, a third coupling point, a fourth coupling point, and a fifth coupling point, the circuit including a first cable having a first drive signal wiring group, a second drive signal wiring group, and a first diagnostic signal wiring group, a second cable having a third drive signal wiring group, a fourth drive signal wiring group, and a second diagnostic signal wiring group, a diagnostic signal output circuit outputting a first diagnostic signal, a second diagnostic signal, a third diagnostic signal, and a fourth diagnostic signal, and a drive signal output circuit outputting a first drive signal and a second drive signal that cause the print head to discharge liquid, in which the first diagnostic signal wiring group includes first diagnostic signal propagation wiring that propagates the first diagnostic signal input to the first coupling point, second diagnostic signal propagation wiring that propagates the second diagnostic signal input to the second coupling point, and third diagnostic signal propagation wiring that propagates the third diagnostic signal input to the third coupling point, the second diagnostic signal wiring group includes fourth diagnostic signal propagation wiring that propagates the fourth diagnostic signal input to the fourth coupling point, and fifth diagnostic signal propagation wiring that propagates a fifth diagnostic signal input to the fifth coupling point, the first drive signal wiring group propagates at least one of the first drive signal and the second drive signal, the second drive signal wiring group propagates at least one of the first drive signal and the second drive signal, the third drive signal wiring group propagates at least one of the first drive signal and the second drive signal, the fourth drive signal wiring group propagates at least one of the first drive signal and the second drive signal, in the first cable, the first diagnostic signal wiring group is provided between the first drive signal wiring group and the second drive signal wiring group, and in the second cable, the second diagnostic signal wiring group is provided between the third drive signal wiring group and the fourth drive signal wiring group.

In the aspect of the print head control circuit, the first drive signal may be a signal that causes the print head to discharge a first amount of liquid, the second drive signal may be a signal that causes the print head to discharge an amount of liquid different from the first amount, the first drive signal wiring group may include first drive signal propagation wiring that propagates the first drive signal, and the second drive signal wiring group may include second drive signal propagation wiring that propagates the second drive signal.

In the aspect of the print head control circuit, the first diagnostic signal propagation wiring may also serve as wiring that propagates a signal defining a discharge timing.

In the aspect of the print head control circuit, the second diagnostic signal propagation wiring may also serve as wiring that propagates a signal defining a waveform switching timing of at least one of the first drive signal and the second drive signal.

In the aspect of the print head control circuit, the third diagnostic signal propagation wiring may also serve as wiring that propagates a signal defining selection of waveforms of the first drive signal and the second drive signal.

In the aspect of the print head control circuit, the print head may include a nozzle from which a black liquid is discharged, and the first drive signal and the second drive signal may be signals that cause the nozzle to discharge the black liquid.

In the aspect of the print head control circuit, the fourth diagnostic signal propagation wiring may also serve as wiring propagating a clock signal.

In the aspect of the print head control circuit, the fifth diagnostic signal propagation wiring may also serve as wiring that propagates a signal indicating presence or absence of temperature abnormality of the print head.

In the aspect of the print head control circuit, the first diagnostic signal wiring group may include first ground signal propagation wiring and a second ground signal propagation wiring that propagate a signal of ground potential, the first ground signal propagation wiring may be provided between the first diagnostic signal propagation wiring, the second diagnostic signal propagation wiring, and the third diagnostic signal propagation wiring, and the first drive signal wiring group, and the second ground signal propagation wiring may be provided between the first diagnostic signal propagation wiring, the second diagnostic signal propagation wiring, and the third diagnostic signal propagation wiring, and the second drive signal wiring group.

In the aspect of the print head control circuit, the second diagnostic signal wiring group may include a third ground signal propagation wiring and a fourth ground signal propagation wiring that propagate a signal of ground potential, the third ground signal propagation wiring may be provided between the fourth diagnostic signal propagation wiring and the fifth diagnostic signal propagation wiring, and the third drive signal wiring group, and the fourth ground signal propagation wiring may be provided between the fourth diagnostic signal propagation wiring and the fifth diagnostic signal propagation wiring, and the fourth drive signal wiring group.

In the aspect of the print head control circuit, the first diagnostic signal wiring group may include a fifth ground signal propagation wiring and a sixth ground signal propagation wiring that propagate a signal of ground potential, the second diagnostic signal propagation wiring may be provided between the first diagnostic signal propagation wiring and the third diagnostic signal propagation wiring, the fifth ground signal propagation wiring may be provided between the first diagnostic signal propagation wiring and the second diagnostic signal propagation wiring, and the sixth ground signal propagation wiring may be provided between the second diagnostic signal propagation wiring and the third diagnostic signal propagation wiring.

In the aspect of the print head control circuit, the second diagnostic signal wiring group may include a seventh ground signal propagation wiring that propagates a signal of ground potential, and the seventh ground signal propagation wiring may be provided between the fourth diagnostic signal propagation wiring and the fifth diagnostic signal propagation wiring.

According to another aspect of the present disclosure, there is provided a liquid discharge apparatus including a print head having a function of performing self-diagnosis in accordance with signals input from a first coupling point, a second coupling point, a third coupling point, a fourth coupling point, and a fifth coupling point, and a print head control circuit controlling an operation of the print head, in which the print head control circuit has a first cable having a first drive signal wiring group, a second drive signal wiring group, and a first diagnostic signal wiring group, a second cable having a third drive signal wiring group, a fourth drive signal wiring group, and a second diagnostic signal wiring group, a diagnostic signal output circuit outputting a first diagnostic signal, a second diagnostic signal, a third diagnostic signal, and a fourth diagnostic signal, and a drive signal output circuit outputting a first drive signal and a second drive signal that cause the print head to discharge liquid, the first diagnostic signal wiring group includes first diagnostic signal propagation wiring that propagates the first diagnostic signal input to the first coupling point, second diagnostic signal propagation wiring that propagates the second diagnostic signal input to the second coupling point, and third diagnostic signal propagation wiring that propagates the third diagnostic signal input to the third coupling point, the second diagnostic signal wiring group includes fourth diagnostic signal propagation wiring that propagates the fourth diagnostic signal input to the fourth coupling point, and fifth diagnostic signal propagation wiring that propagates a fifth diagnostic signal input to the fifth coupling point, the first drive signal wiring group propagates at least one of the first drive signal and the second drive signal, the second drive signal wiring group propagates at least one of the first drive signal and the second drive signal, the third drive signal wiring group propagates at least one of the first drive signal and the second drive signal, the fourth drive signal wiring group propagates at least one of the first drive signal and the second drive signal, in a first contact group in which the first cable and the print head are in electrical contact with each other, a first contact portion in which the first coupling point and the first diagnostic signal propagation wiring are in electrical contact with each other, a second contact portion in which the second coupling point and the second diagnostic signal propagation wiring are in electrical contact with each other, and a third contact portion in which the third coupling point and the third diagnostic signal propagation wiring are in electrical contact with each other are located between a first drive signal contact group in which the first drive signal wiring group is in electrical contact with the print head, and a second drive signal contact group in which the second drive signal wiring group is in electrical contact with the print head, and in a second contact group in which the second cable and the print head are in electrical contact with each other, a fourth contact portion in which the fourth coupling point and the fourth diagnostic signal propagation wiring are in electrical contact with each other, and a fifth contact portion in which the fifth coupling point and the fifth diagnostic signal propagation wiring are in electrical contact with each other are located between a third drive signal contact group in which the third drive signal wiring group is in electrical contact with the print head, and a fourth drive signal contact group in which the fourth drive signal wiring group is in electrical contact with the print head.

In the aspect of the liquid discharge apparatus, the first drive signal may be a signal that causes the print head to discharge a first amount of liquid, the second drive signal may be a signal that causes the print head to discharge an amount of liquid different from the first amount, the first drive signal wiring group may include first drive signal propagation wiring that propagates the first drive signal, and the second drive signal wiring group may include second drive signal propagation wiring that propagates the second drive signal.

In the aspect of the liquid discharge apparatus, the first contact portion may be in electrical contact with wiring that propagates a signal defining a discharge timing.

In the aspect of the liquid discharge apparatus, the second contact portion may be in electrical contact with wiring that propagates a signal defining a waveform switching timing of at least one of the first drive signal and the second drive signal.

In the aspect of the liquid discharge apparatus, the third contact portion may be in electrical contact with wiring that propagates a signal defining selection of waveforms of the first drive signal and the second drive signal.

In the aspect of the liquid discharge apparatus, the print head may include a nozzle from which a black liquid is discharged, and the first drive signal and the second drive signal may be signals that cause the nozzle to discharge the black liquid.

In the aspect of the liquid discharge apparatus, the fourth contact portion may be in electrical contact with wiring that propagates a clock signal.

In the aspect of the liquid discharge apparatus, the fifth contact portion may be in electrical contact with wiring propagating a signal indicating presence or absence of temperature abnormality of the print head.

In the aspect of the liquid discharge apparatus, the first diagnostic signal wiring group may include a first ground signal propagation wiring and a second ground signal propagation wiring that propagate a signal of ground potential, in the first contact group, a sixth contact portion in which the first ground signal propagation wiring and the print head are in electrical contact with each other may be located between the first contact portion, the second contact portion, and the third contact portion, and the first drive signal contact group, and a seventh contact portion in which the second ground signal propagation wiring and the print head are in electrical contact with each other may be located between the first contact portion, the second contact portion, and the third contact portion, and the second drive signal contact group.

In the aspect of the liquid discharge apparatus, the second diagnostic signal wiring group may include a third ground signal propagation wiring and a fourth ground signal propagation wiring that propagate a signal of ground potential, in the second contact group, an eighth contact portion in which the third ground signal propagation wiring and the print head are in electrical contact with each other may be located between the fourth contact portion and the fifth contact portion, and the third drive signal contact group, and a ninth contact portion in which the fourth ground signal propagation wiring and the print head are in electrical contact with each other may be located between the fourth contact portion and the fifth contact portion, and the fourth drive signal contact group.

In the aspect of the liquid discharge apparatus, the first diagnostic signal wiring group may include a fifth ground signal propagation wiring and a sixth ground signal propagation wiring that propagate a signal of ground potential, in the first contact group, the second contact portion may be located between the first contact portion and the third contact portion, a tenth contact portion in which the fifth ground signal propagation wiring and the print head are in electrical contact with each other may be located between the first contact portion and the second contact portion, and an eleventh contact portion in which the sixth ground signal propagation wiring and the print head are in electrical contact with each other may be located between the second contact portion and the third contact portion.

In the aspect of the liquid discharge apparatus, the second diagnostic signal wiring group may include seventh ground signal propagation wiring that propagates a signal of ground potential, in the second contact group, a twelfth contact portion in which the seventh ground signal propagation wiring and the print head are in electrical contact with each other may be located between the fourth contact portion and the fifth contact portion.

BRIEF DESCRIPTION OF THE DRAWINGS

FIG. 18 is a table for describing the details of a signal propagated through a first cable.

FIG. 19 is a table for describing the details of a signal propagated through a second cable.

DESCRIPTION OF EXEMPLARY EMBODIMENTS

Hereinafter, preferred embodiments of the present disclosure will be described with reference to the drawings. The drawings used are for convenience of description. The embodiments described below do not unduly limit the scope of the disclosure as disclosed in the aspects. In addition, not all of the configurations described below are necessarily essential configuration requirements of the present disclosure.

Hereinafter, a print head control circuit according to the present disclosure will be described by taking a print head control circuit for operating a print head including a self-diagnosis function applied to a liquid discharge apparatus as an example.

1. Outline of Liquid Discharge Apparatus

Figure 1:
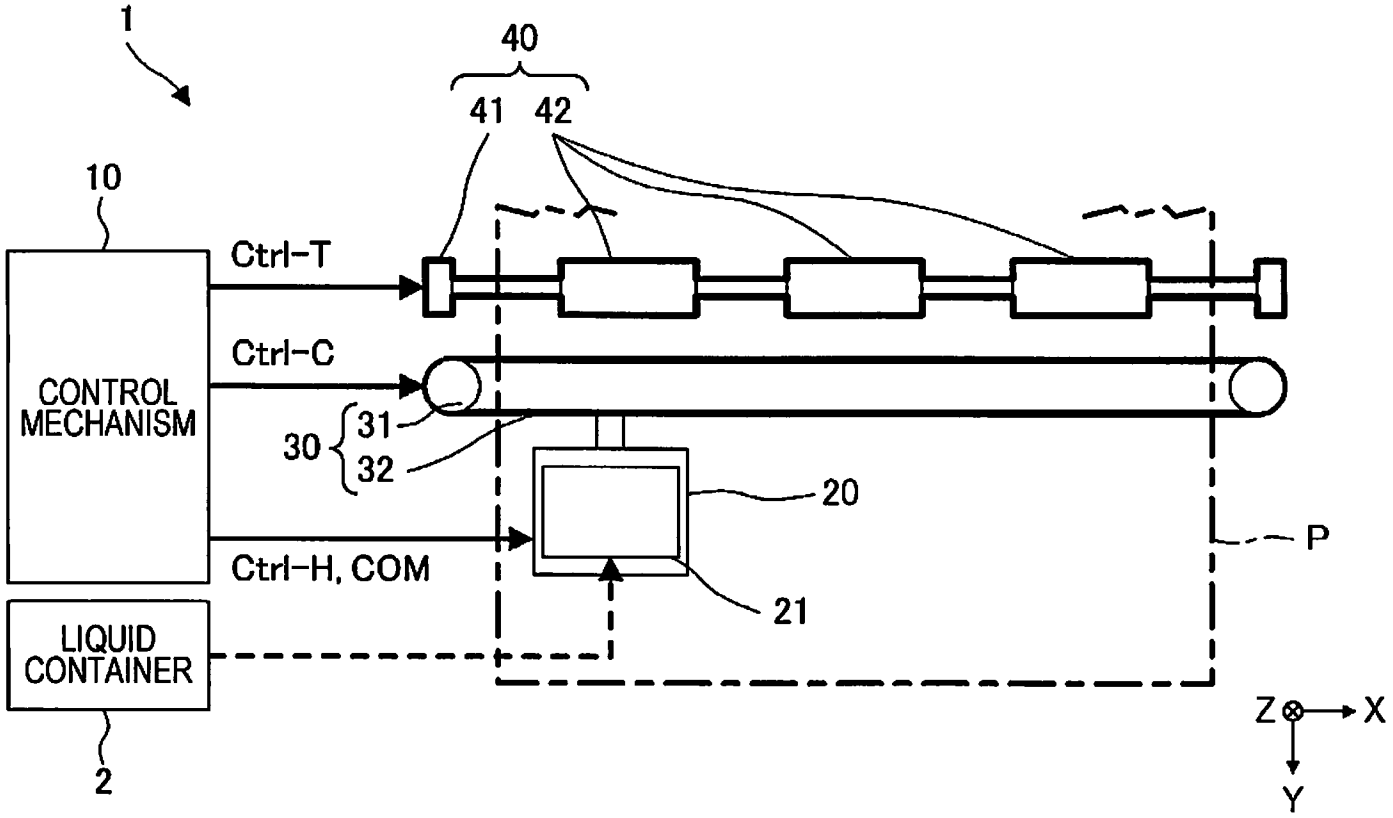
FIG. 1 is a diagram illustrating a schematic configuration of a liquid discharge apparatus.

FIG. 1 is a diagram illustrating a schematic configuration of a liquid discharge apparatus 1 to which a print head control circuit of the present embodiment is applied. The liquid discharge apparatus 1 according to the present embodiment is a serial printing ink jet printer in which a carriage 20 mounted with a print head 21 discharging an ink as an example of a liquid reciprocates, and which discharges the ink to a medium P to be transported. In the following description, a direction in which the carriage 20 moves is referred to as an X direction, a direction in which the medium P is transported is referred to as a Y direction, and a direction in which the ink is discharged is referred to as a Z direction. In the following description, the X direction, the Y direction, and the Z direction will be described as directions orthogonal to each other. In addition, as the medium P, any printing object such as printing paper, resin film, fabric may be used.

The liquid discharge apparatus 1 is provided with a liquid container 2, a control mechanism 10, the carriage 20, a movement mechanism 30, and a transport mechanism 40.

The liquid container 2 stores a plurality of types of ink to be discharged to the medium P. Specifically, six types of ink of black, cyan, magenta, yellow, red, and gray are stored in the liquid container 2. The number and type of the ink stored in the liquid container 2 described above is an example, and the number of the inks stored in the liquid container 2 may be five or less, or may be seven or more. Furthermore, the liquid container 2 may store inks of colors such as light cyan, light magenta, and green. As the liquid container 2 in which such ink is stored, an ink cartridge, a bag-like ink pack formed of a flexible film, an ink tank capable of replenishing the ink, or the like is used.

The control mechanism 10 includes a processing circuit such as a central processing unit (CPU), a field programmable gate array (FPGA), and a storage circuit such as a semiconductor memory, for example, and controls each element of the liquid discharge apparatus 1.

The print head 21 is mounted on the carriage 20. In addition, the carriage 20 is fixed to an endless belt 32 included in the movement mechanism 30 in a state where the print head 21 is mounted. The liquid container 2 may also be mounted on the carriage 20.

A control signal Ctrl-H including a plurality of signals for controlling the print head 21 and a plurality of drive signals COM for driving the print head 21 are input to the print head 21 from the control mechanism 10. The print head 21 discharges the ink supplied from the liquid container 2 in the Z direction based on the control signal Ctrl-H and the plurality of drive signals COM.

The movement mechanism 30 includes a carriage motor 31 and the endless belt 32. The carriage motor 31 operates based on a control signal Ctrl-C input from the control mechanism 10. The endless belt 32 rotates in accordance with the operation of the carriage motor 31. As a result, the carriage 20 fixed to the endless belt 32 reciprocates in the X direction.

The transport mechanism 40 includes a transport motor 41 and a transport roller 42. The transport motor 41 operates based on a control signal Ctrl-T input from the control mechanism 10. The transport roller 42 rotates in accordance with the operation of the transport motor 41. The medium P is transported in the Y direction as the transport roller 42 rotates.

As described above, the liquid discharge apparatus 1 discharges the ink from the print head 21 mounted on the carriage 20 in conjunction with the transport of the medium P by the transport mechanism 40 and the reciprocation of the carriage 20 by the movement mechanism 30, to cause the ink to be landed on any position on the surface of the medium P, and to form a desired image on the medium P.

2. Electrical Configuration of Liquid Discharge Apparatus

Figure 2:
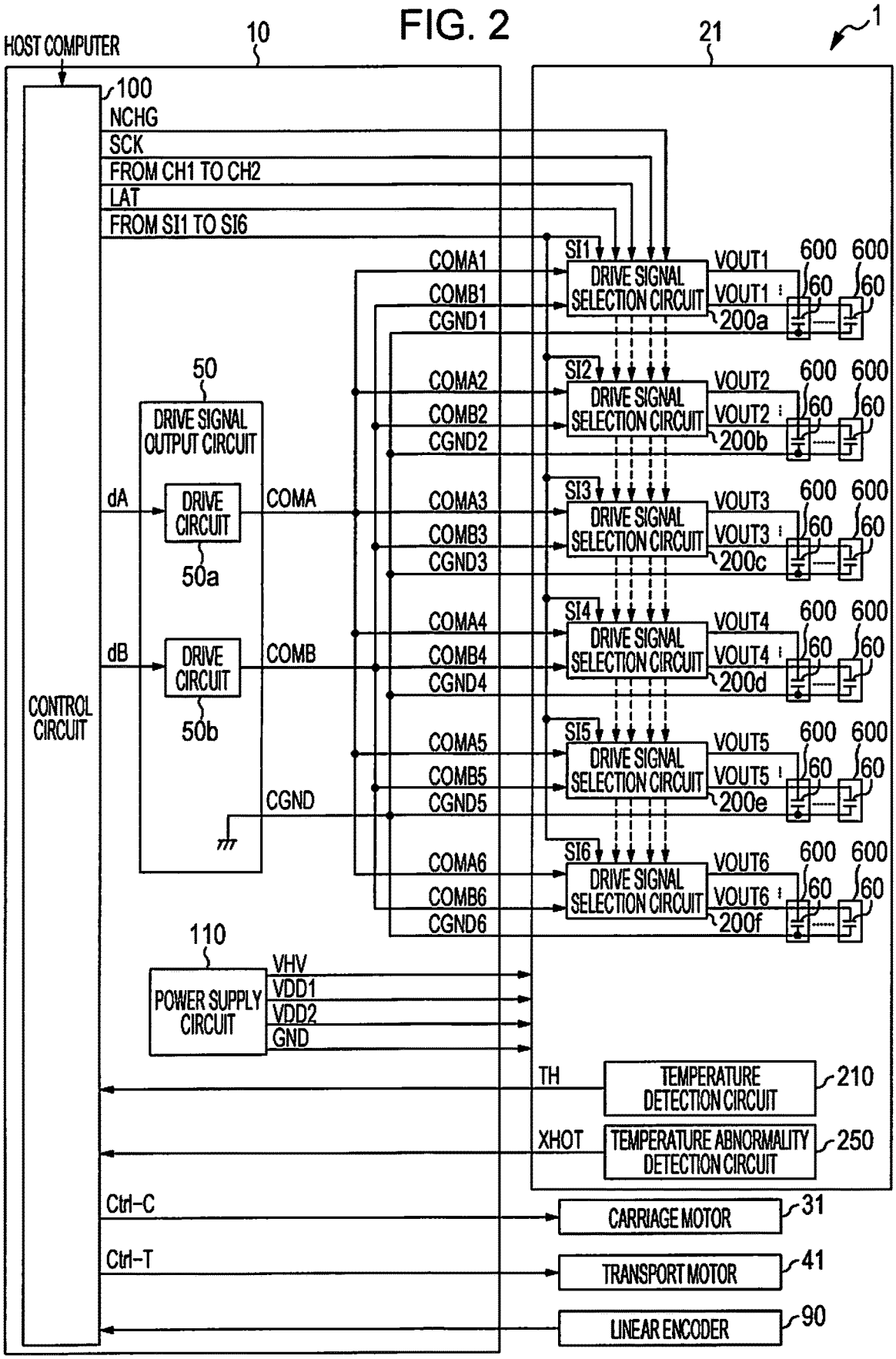
FIG. 2 is a block diagram illustrating an electrical configuration of the liquid discharge apparatus.

FIG. 2 is a block diagram illustrating an electrical configuration of the liquid discharge apparatus 1. The liquid discharge apparatus 1 is provided with the control mechanism 10, the print head 21, the carriage motor 31, the transport motor 41, and a linear encoder 90. As illustrated in FIG. 2, the control mechanism 10 includes a drive signal output circuit 50, a control circuit 100, and a power supply circuit 110.

The control circuit 100 includes a processor such as a microcontroller, for example. The control circuit 100 generates data and signals for controlling the liquid discharge apparatus 1 based on various signals such as image data supplied from a host computer.

Specifically, the control circuit 100 grasps a scanning position of the print head 21 based on a detection signal input from the linear encoder 90. The control circuit 100 outputs, to the carriage motor 31, a control signal Ctrl-C corresponding to the scanning position of the print head 21. As a result, the reciprocation of the print head 21 is controlled. In addition, the control circuit 100 outputs the control signal Ctrl-T to the transport motor 41. As a result, transport of the medium P is controlled. The control signal Ctrl-C may be supplied to the carriage motor 31 after being signal-converted via a carriage motor driver (not illustrated). Similarly, the control signal Ctrl-T may be supplied to the transport motor 41 after being signal-converted via a transport motor driver (not illustrated).

In addition, the control circuit 100 outputs six print data signals SI1 to SI6, two change signals CH1 and CH2, a latch signal LAT, a clock signal SCK, and an N-charge signal NCHG to the print head 21, as a control signal Ctrl-H for controlling the print head 21 based on various signals such as image data supplied from the host computer.

In addition, the control circuit 100 outputs drive control signals dA and dB serving as digital signals to the drive signal output circuit 50.

The drive signal output circuit 50 includes a drive circuit 50*a* and a drive circuit 50*b*. The drive signal output circuit 50 generates and outputs drive signals COMA and COMB as the plurality of drive signals COM. In addition, the drive signal output circuit 50 generates and outputs a reference voltage signal CGND of a ground potential (0 V) indicating a reference potential of the drive signals COMA and COMB, for example. The reference voltage signal CGND is not limited to the voltage signal of the ground potential, and may be a DC 6 V voltage signal, for example.

Specifically, the drive control signal dA is input to the drive circuit 50*a*. The drive circuit 50*a* performs digital/analog conversion of the drive control signal dA, and thereafter performs class D amplification on the converted analog signal to generate the drive signal COMA. In addition, the drive control signal dB is input to the drive circuit 50*b*. The drive circuit 50*b* performs digital/analog conversion on the drive control signal dB, and thereafter performs class D amplification on the converted analog signal to generate the drive signal COMB. That is, the drive control signals dA and dB are digital data signals that define waveforms of the drive signals COMA and COMB, and the drive circuits 50*a* and 50*b* generate the drive signals COMA and COMB by performing class D amplification on waveforms defined by the drive control signals dA and dB. The generated drive signals COMA and COMB are output from the drive signal output circuit 50. The drive control signals dA and dB may be analog signals that define the waveforms of the drive signals COMA and COMB. The drive circuits 50*a* and 50*b* may amplify the waveforms defined by the drive control signals dA and dB by class A amplification, class B amplification, class AB amplification or the like.

The drive signal COMA is branched to drive signals COMA1 to COMA6 in the control mechanism 10 and thereafter output to the print head 21. In addition, the drive signal COMB is branched to drive signals COMB1 to COMB6 in the control mechanism 10, and thereafter output to the print head 21. In addition, the reference voltage signal CGND is branched to reference voltage signals CGND1 to CGND6 in the control mechanism 10 and thereafter output to the print head 21. One of the drive signal COMA including the drive signals COMA1 to COMA6 and the drive signal COMB including the drive signals COMB1 to COMB6 is an example of a first drive signal. The different one of the drive signals COMA including the drive signals COMA1 to COMA6 and the drive signal COMB including the drive signals COMB1 to COMB6 is an example of a second drive signal.

The power supply circuit 110 generates and outputs a high voltage signal VHV, low voltage signals VDD1 and VDD2, and a ground signal GND. For example, the high voltage signal VHV is a voltage signal of DC 42 V. In addition, for example, the low voltage signals VDD1 and VDD2 are 3.3 V voltage signals. In addition, the ground signal GND is a voltage signal indicating the reference potential of the high voltage signal VHV and the low voltage signals VDD1 and VDD2, and is a voltage signal of the ground potential (0 V), for example. Each of the high voltage signal VHV, the low voltage signals VDD1 and VDD2, and the ground signal GND is used as a power supply voltage of various configurations in the control mechanism 10 and is output to the print head 21. The power supply circuit 110 may generate various voltage signals other than the high voltage signal VHV, the low voltage signals VDD1 and VDD2, and the ground signal GND.

The print head 21 includes six drive signal selection circuits 200*a* to 200*f*, a plurality of discharge portions 600, a temperature detection circuit 210, and a temperature abnormality detection circuit 250.

Each of the drive signal selection circuits 200*a* to 200*f* generates drive signals VOUT1 to VOUT6 by selecting or not selecting each of the drive signals COMA1 to COMA6 and each of the drive signal COMB1 to COMB6 based on the input print data signals SI1 to SI6, the clock signal SCK, the latch signal LAT, and the change signals CH1 and CH2, and supplies the drive signals to a piezoelectric element 60 included in the corresponding discharge portion 600. The piezoelectric element 60 is displaced by the supply of the drive signal VOUT. An amount of ink corresponding to the displacement is discharged from the discharge portion 600.

The drive signals COMA1 and COMB1, the print data signal SI1, the latch signal LAT, the change signals CH1 and CH2, and the clock signal SCK are input to the drive signal selection circuit 200*a*. The drive signal selection circuit 200*a* outputs the drive signal VOUT1 by selecting or not selecting the drive signals COMA1 and COMB1 based on the print data signal SI1, the latch signal LAT, the change signals CH1 and CH2, and the clock signal SCK. The drive signal VOUT1 is supplied to one end of the piezoelectric element 60 of the discharge portion 600 provided correspondingly. In addition, the reference voltage signal CGND1 is supplied to the other end of the piezoelectric element 60. The piezoelectric element 60 is displaced by the potential difference between the drive signal VOUT1 and the reference voltage signal CGND1.

Similarly, the drive signals COMA2 and COMB2, the print data signal SI2, the latch signal LAT, the change signals CH1 and CH2, and the clock signal SCK are input to the drive signal selection circuit 200*b*. The drive signal selection circuit 200*b* outputs the drive signal VOUT2 by selecting or not selecting the drive signals COMA2 and COMB2 based on the print data signal SI2, the latch signal LAT, the change signals CH1 and CH2, and the clock signal SCK. The drive signal VOUT2 is supplied to one end of the piezoelectric element 60 of the discharge portion 600 provided correspondingly. In addition, the reference voltage signal CGND2 is supplied to the other end of the piezoelectric element 60. The piezoelectric element 60 is displaced by the potential difference between the drive signal VOUT2 and the reference voltage signal CGND2.

Similarly, the drive signals COMA3 and COMB3, the print data signal SI3, the latch signal LAT, the change signals CH1 and CH2, and the clock signal SCK are input to the drive signal selection circuit 200*c*. The drive signal selection circuit 200*c* outputs the drive signal VOUT3 by selecting or not selecting the drive signals COMA3 and COMB3 based on the print data signal SI3, the latch signal LAT, the change signals CH1 and CH2, and the clock signal SCK. The drive signal VOUT3 is supplied to one end of the piezoelectric element 60 of the discharge portion 600 provided correspondingly. In addition, the reference voltage signal CGND3 is supplied to the other end of the piezoelectric element 60. The piezoelectric element 60 is displaced by the potential difference between the drive signal VOUT3 and the reference voltage signal CGND3.

Similarly, the drive signals COMA4 and COMB4, the print data signal SI4, the latch signal LAT, the change signals CH1 and CH2, and the clock signal SCK are input to the drive signal selection circuit 200*d*. The drive signal selection circuit 200*d* outputs a drive signal VOUT4 by selecting or not selecting the drive signals COMA4 and COMB4 based on the print data signal SI4, the latch signal LAT, the change signals CH1 and CH2, and the clock signal SCK. The drive signal VOUT4 is supplied to one end of the piezoelectric element 60 of the discharge portion 600 provided correspondingly. In addition, the reference voltage signal CGND4 is supplied to the other end of the piezoelectric element 60. The piezoelectric element 60 is displaced by the potential difference between the drive signal VOUT4 and the reference voltage signal CGND4.

Similarly, the drive signals COMA5 and COMB5, the print data signal SI5, the latch signal LAT, the change signals CH1 and CH2, and the clock signal SCK are input to the drive signal selection circuit 200*e*. The drive signal selection circuit 200*e* outputs the drive signal VOUT5 by selecting or not selecting the drive signals COMA5 and COMB5 based on the print data signal SI5, the latch signal LAT, the change signals CH1 and CH2, and the clock signal SCK. The drive signal VOUT5 is supplied to one end of the piezoelectric element 60 of the discharge portion 600 provided correspondingly. In addition, the reference voltage signal CGND5 is supplied to the other end of the piezoelectric element 60. The piezoelectric element 60 is displaced by the potential difference between the drive signal VOUT5 and the reference voltage signal CGND5.

Similarly, the drive signals COMA6 and COMB6, the print data signal SI6, the latch signal LAT, the change signals CH1 and CH2, and the clock signal SCK are input to the drive signal selection circuit 200*f*. The drive signal selection circuit 200*f* outputs the drive signal VOUT6 by selecting or not selecting the drive signals COMA6 and COMB6 based on the print data signal SI6, the latch signal LAT, the change signals CH1 and CH2, and the clock signal SCK. The drive signal VOUT6 is supplied to one end of the piezoelectric element 60 of the discharge portion 600 provided correspondingly. In addition, the reference voltage signal CGND6 is supplied to the other end of the piezoelectric element 60. The piezoelectric element 60 is displaced by the potential difference between the drive signal VOUT6 and the reference voltage signal CGND6.

Here, the drive signal selection circuits 200*a* to 200*f* have the same circuit configuration. Therefore, in the following description, the drive signal selection circuits 200*a* to 2002 may be referred to as the drive signal selection circuit 200 when it is not necessary to distinguish these in particular. In this case, the drive signals COMA1 to COMA6 and COMB1 to COMB6 input to the drive signal selection circuit 200 are referred to as the drive signals COMA and COMB, and the print data signals SI1 to SI6 are referred to as the print data signal SI. In addition, the drive signals VOUT1 to VOUT6 output from the drive signal selection circuit 200 are referred to as the drive signal VOUT.

The temperature detection circuit 210 includes a temperature sensor such as a thermistor (not illustrated). The temperature sensor detects the temperature of the print head 21. The temperature detection circuit 210 generates a temperature signal TH, which is an analog signal including temperature information of the print head 21, and outputs the temperature signal TH to the control circuit 100.

The temperature abnormality detection circuit 250 generates an abnormal signal XHOT of a digital signal indicating whether a temperature abnormality occurs in the print head 21 and the drive signal selection circuit 200, and outputs the abnormal signal XHOT to the control circuit 100. Specifically, the temperature abnormality detection circuit 250 outputs the abnormal signal XHOT at the H level when it is determined that the temperature abnormality does not occur in the print head 21 and the drive signal selection circuit 200, and outputs the abnormality signal XHOT at the L level when it is determined that temperature abnormality occurs in the print head 21 or the drive signal selection circuit 200. The logic level of the abnormal signal XHOT is an example. For example, the temperature abnormality detection circuit 250 may output the abnormal signal XHOT at the L level when it is determined that the temperatures of the print head 21 and the drive signal selection circuit 200 are normal, and may output the abnormal signal XHOT at the H level when it is determined that the temperature of the print head 21 or the drive signal selection circuit 200 is abnormal.

The control circuit 100 performs various processing according to the temperature signal TH and the abnormal signal XHOT. In other words, the abnormal signal XHOT is a signal indicating the presence or absence of temperature abnormality of the print head 21 and the drive signal selection circuit 200. As a result, it is possible to improve discharge accuracy of the ink from the discharge portion 600, and to prevent the operation abnormality, the failure, and the like of the print head 21 and the drive signal selection circuit 200 in the printing state. 3. Example of Drive Signal Waveform Here, an example of the waveforms of the drive signals COMA and COMB generated by the drive signal output circuit 50 and an example of the waveform of the drive signal VOUT supplied to the piezoelectric element 60 will be described with reference to FIGS. 3 and 4.

Figure 3:
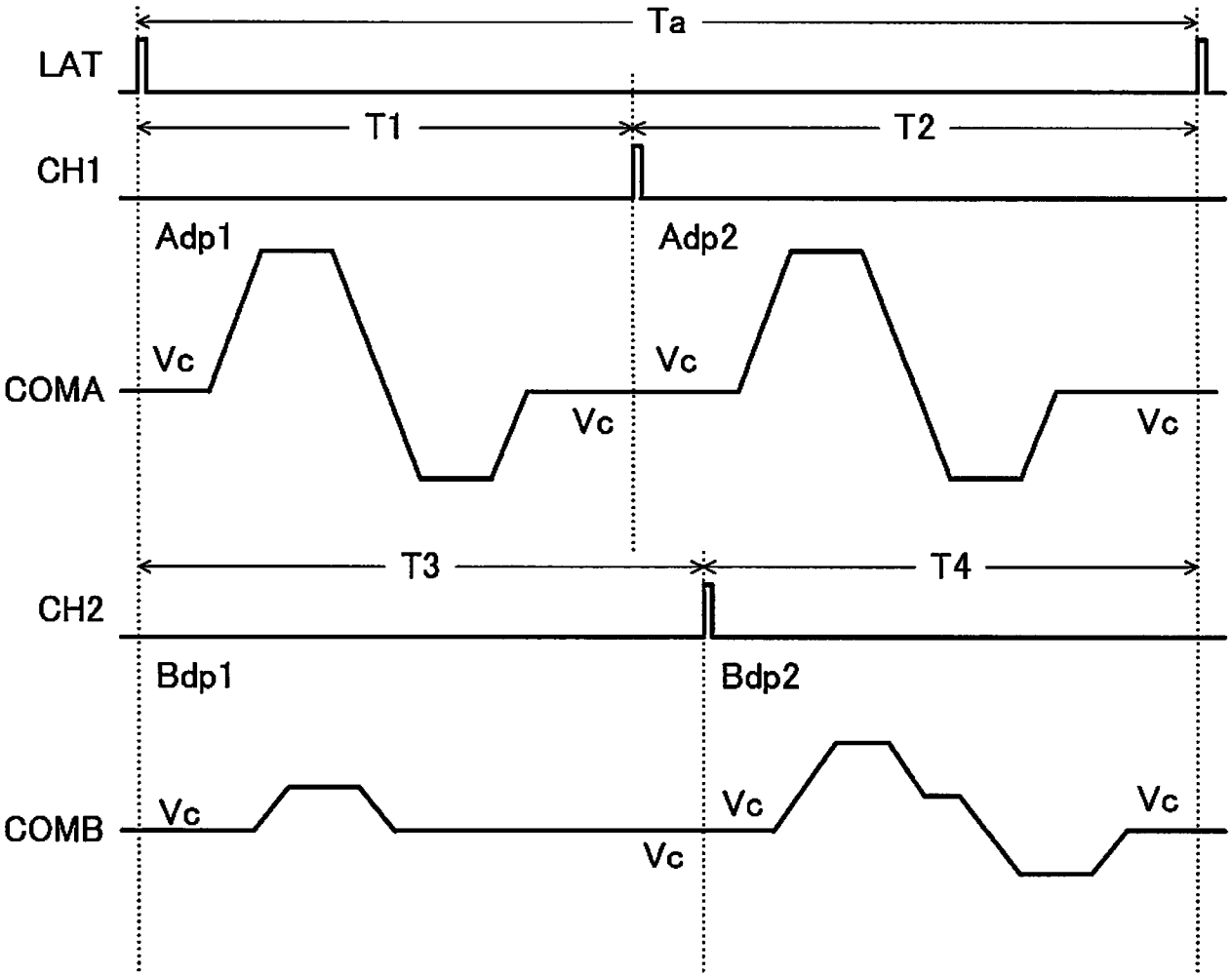
FIG. 3 is a diagram illustrating an example of drive signals COMA and COMB.

FIG. 3 is a diagram illustrating an example of the drive signals COMA and COMB. As illustrated in FIG. 3, the drive signal COMA is a waveform in which a trapezoidal waveform Adp1 disposed in a period T1 from the rise of the latch signal LAT to the rise of the change signal CH1 and a trapezoidal waveform Adp2 disposed in a period T2 from the rise of the change signal CH1 to the subsequent rise of the latch signal LAT are continuous. In the present embodiment, the trapezoidal waveform Adp1 and the trapezoidal waveform Adp2 are waveforms that cause the ink of approximately the same amount to be discharged. When the drive signal COMA with the trapezoidal waveforms Adp1 and Adp2 is supplied to one end of the piezoelectric element 60, a medium amount of ink is discharged from the discharge portion 600 corresponding to the piezoelectric element 60.

In addition, the drive signal COMB is a waveform in which a trapezoidal waveform Bdp1 disposed in a period T3 from the rise of the latch signal LAT to the rise of the change signal CH2 and a trapezoidal waveform Bdp2 disposed in a period T4 from the rise of the change signal CH2 to the subsequent rise of the latch signal LAT are continuous. In the present embodiment, the trapezoidal waveform Bdp1 and the trapezoidal waveform Bdp2 are waveforms different from each other. Among these, the trapezoidal waveform Bdp1 is a waveform for finely vibrating the ink in the vicinity of a nozzle opening portion of the discharge portion 600 to prevent an increase in the ink viscosity. When the drive signal COMB with the trapezoidal waveform Bdp1 is supplied to one end of the piezoelectric element 60, the ink is not discharged from the discharge portion 600 corresponding to the piezoelectric element 60. In addition, the trapezoidal waveform Bdp2 is a waveform different from the trapezoidal waveforms Adp1 and Adp2, and the trapezoidal waveform Bdp1. When the drive signal COMB with the trapezoidal waveform Bdp2 is supplied to one end of the piezoelectric element 60, an ink smaller than the medium amount is discharged from the discharge portion 600 corresponding to the piezoelectric element 60.

As described above, the discharge portion 600 discharges different amounts of ink when the drive signal COMA is supplied to the piezoelectric element 60 and when the drive signal COMB is supplied to the piezoelectric element 60. That is, one of the amount of ink discharged from the discharge portion 600 when the drive signal COMA is supplied to the piezoelectric element 60 or the amount of ink discharged from the discharge portion 600 when the drive signal COMB is supplied to the piezoelectric element 60 is an example of a first amount. The other of the amount of ink discharged from the discharge portion 600 is an example of an amount different from the first amount.

Here, the period Ta from the rise of the latch signal LAT to the subsequent rise of the latch signal LAT corresponds to a printing period forming a new dot on the medium P. That is, the latch signal LAT is a signal that defines a discharge timing. In addition, the change signal CH1 is a signal that defines a waveform switching timing of the trapezoidal waveform Adp1 and the trapezoidal waveform Adp2 included in the drive signal COMA. In addition, the change signal CH2 is a signal that defines a waveform switching timing of the trapezoidal waveform Bdp1 and the trapezoidal waveform Bdp2 included in the drive signal COMB.

The voltages at the start timing and the end timing of each of the trapezoidal waveforms Adp1, Adp2, Bdp1, and Bdp2 are common to the voltage Vc. That is, the trapezoidal waveforms Adp1, Adp2, Bdp1, and Bdp2 are waveforms that start at voltage Vc and end at voltage Vc. Although each of the drive signals COMA and COMB is described as being a waveform signal in which two trapezoidal waveforms are continuous in the period Ta, it may be a waveform signal in which three or more trapezoidal waveforms are continuous.

Figure 4:
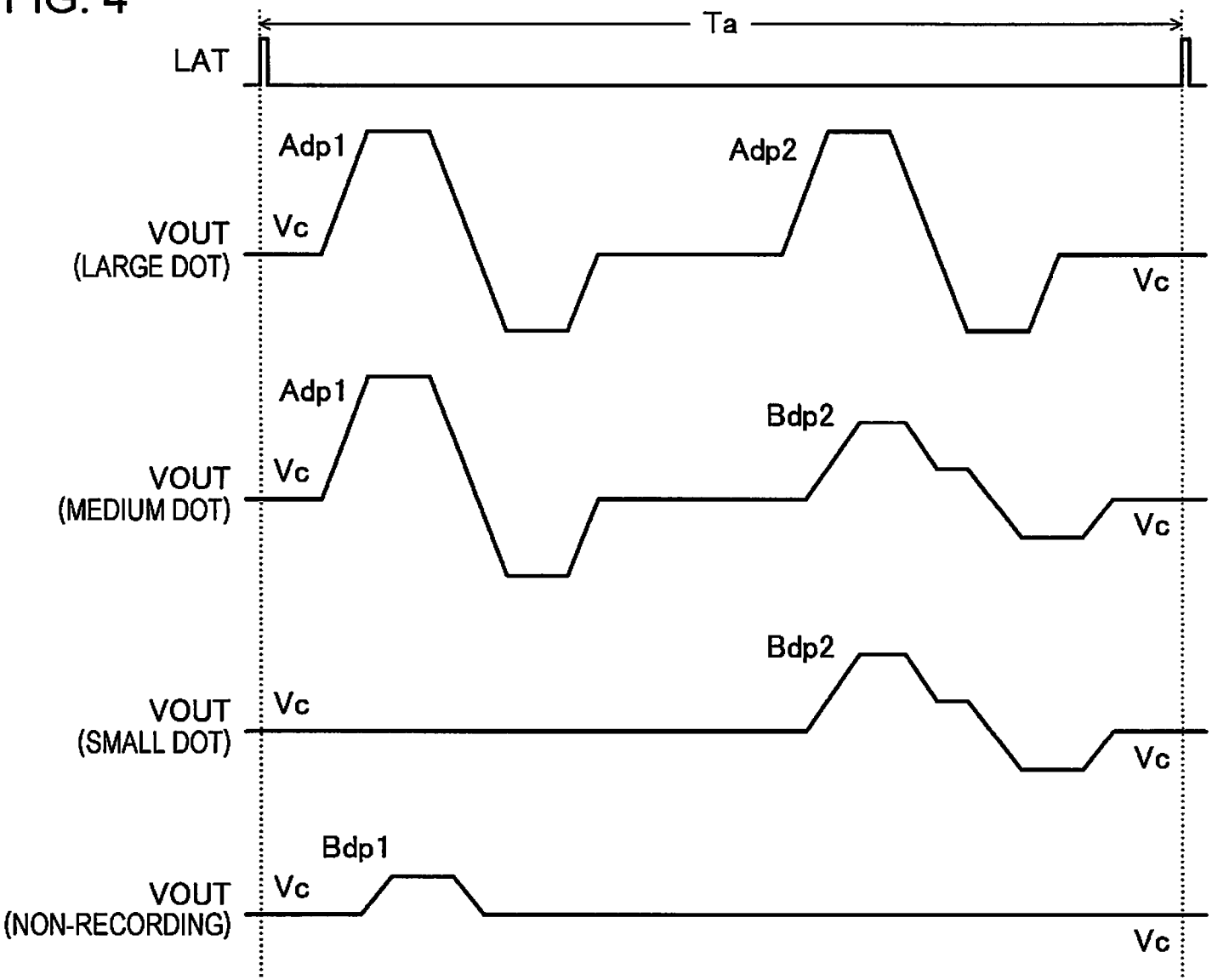
FIG. 4 is a diagram illustrating an example of a drive signal VOUT.

FIG. 4 is a diagram illustrating an example of the drive signal VOUT corresponding to each of "large dot", "medium dot", "small dot", and "non-recording".

As illustrated in FIG. 4, the drive signal VOUT corresponding to the "large dot" is a waveform in which the trapezoidal waveform Adp1 and the trapezoidal waveform Adp2 are continuous in the period Ta. When the drive signal VOUT is supplied to one end of the piezoelectric element 60, a medium amount of ink is separately discharged twice from the discharge portion 600 corresponding to the piezoelectric element 60 in the period Ta. Accordingly, each of the inks lands on the medium P and coalesces to form large dots.

The drive signal VOUT corresponding to the "medium dot" is a waveform in which the trapezoidal waveform Adp1 and the trapezoidal waveform Bdp2 are continuous in the period Ta. When the drive signal VOUT is supplied to one end of the piezoelectric element 60, a medium amount of ink and a small amount of ink are discharged from the discharge portion 600 corresponding to the piezoelectric element 60 in the period Ta. Accordingly, each of the inks lands on the medium P and coalesces to form medium dots.

The drive signal VOUT corresponding to the "small dot" has a trapezoidal waveform Bdp2 in the period Ta. When the drive signal VOUT is supplied to one end of the piezoelectric element 60, a small amount of ink is discharged from the discharge portion 600 corresponding to the piezoelectric element 60 in the period Ta. Accordingly, the ink lands on the medium P to form small dot.

The drive signal VOUT corresponding to the "non-recording" has a trapezoidal waveform Bdp1 in the period Ta. When the drive signal VOUT is supplied to one end of the piezoelectric element 60, the ink in the vicinity of the nozzle opening portion of the discharge portion 600 corresponding to the piezoelectric element 60 is only slightly vibrated in the period Ta, and the ink is not discharged. Therefore, the ink does not land on the medium P, and the dots are not formed.

Here, when neither of the drive signals COMA and COMB is selected as the drive signal VOUT, the previous voltage Vc is held at one end of the piezoelectric element 60 by the capacitive component of the piezoelectric element 60. That is, when neither of the drive signals COMA and COMB is selected, the voltage Vc is supplied to the piezoelectric element 60 as the drive signal VOUT.

The drive signals COMA and COMB and the drive signal VOUT illustrated in FIGS. 3 and 4 are merely examples. Various combinations of waveforms may be used in accordance with the moving speed of the carriage 20 on which the print head 21 is mounted, the physical properties of the ink to be discharged, the material of the medium P, and the like. In addition, the drive signal COMA and the drive signal COMB may be signals in which the same trapezoidal waveforms are continuous.

4. Configuration and Operation of Drive Signal Selection Circuit

Figure 5:
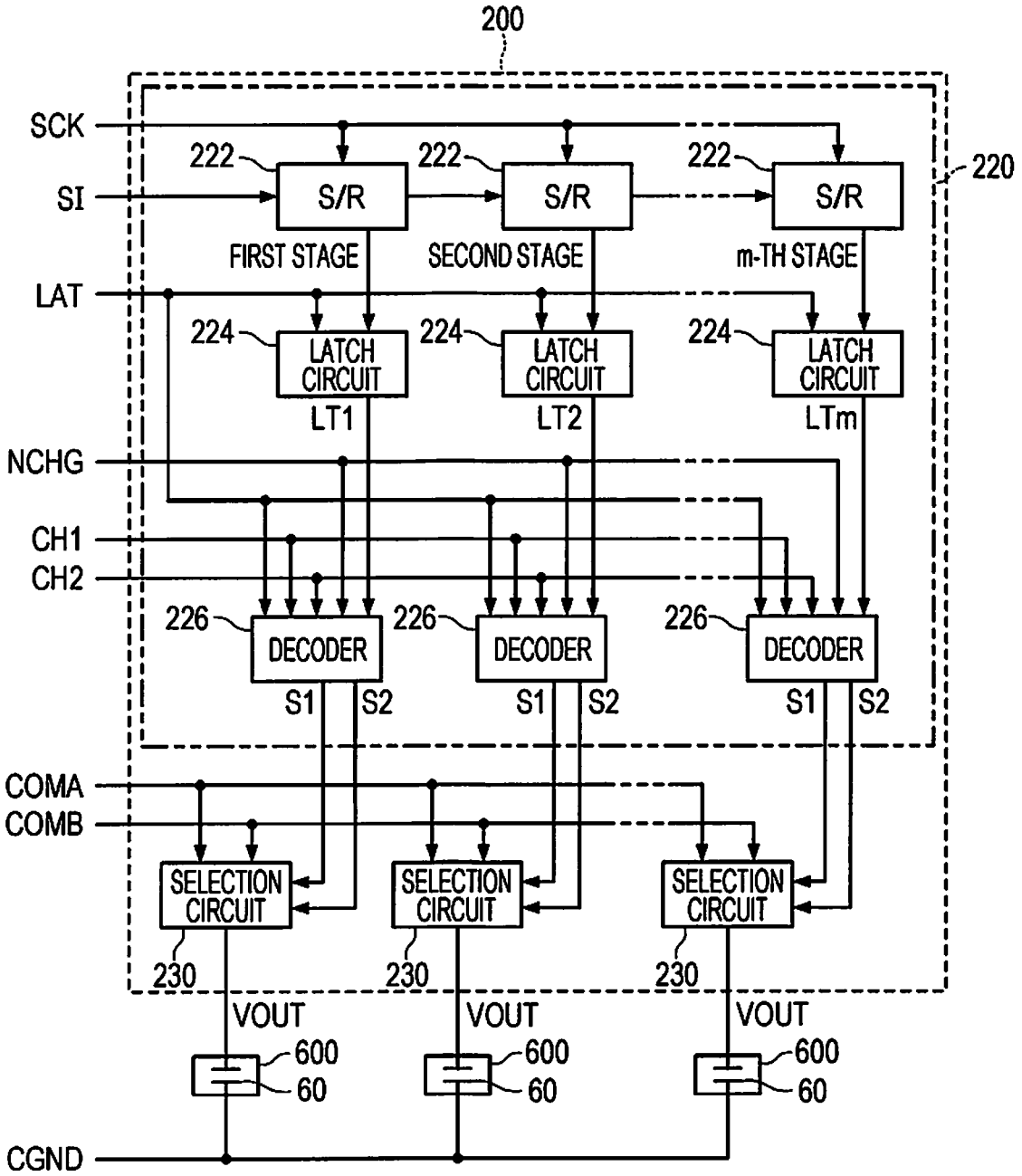
FIG. 5 is a diagram illustrating a configuration of a drive signal selection circuit.

Next, the configuration and operation of the drive signal selection circuit 200 will be described with reference to FIGS. 5 to 8. FIG. 5 is a diagram illustrating the configuration of the drive signal selection circuit 200. As illustrated in FIG. 5, the drive signal selection circuit 200 includes a selection control circuit 220 and a plurality of selection circuits 230.

The print data signal SI, the latch signal LAT, the change signals CH1 and CH2, the clock signal SCK, and the N-charge signal NCHG are input to the selection control circuit 220. In addition, in the selection control circuit 220, a set of a shift register (S/R) 222, a latch circuit 224, and a decoder 226 is provided corresponding to each of the plurality of discharge portions 600. That is, the drive signal selection circuit 200 includes the same number of sets of the shift register 222, the latch circuit 224, and the decoder 226 as the total number m of the corresponding discharge portions 600.

The print data signal SI is a signal that defines the waveform selection of the drive signal COMA and the drive signal COMB. Specifically, the print data signal SI is a signal synchronized with the clock signal SCK, and is a signal of 2m-bit in total including 2-bit print data [SIH, SIL] for selecting one of "large dot", "medium dot", "small dot", and "non-recording", for each of the m discharge portions 600. The print data signal SI is held in the shift register 222 for each 2-bit print data [SIH, SIL] included in the print data signal SI, corresponding to the discharge portion 600. Specifically, the m stages of shift registers 222 corresponding to the discharge portion 600 are cascade-coupled to each other, and the serially supplied print data signal SI is sequentially transferred to the subsequent stage in accordance with the clock signal SCK. In FIG. 5, in order to distinguish the shift register 222, it is described that first stage, second stage, . . . , and m-th stage in order from the upstream to which the print data signal SI is supplied.

Each of the m latch circuits 224 latches the 2-bit print data [SIH, SIL] held by each of the m shift registers 222 at the rise of the latch signal LAT.

Each of m decoders 226 decodes the 2-bit print data [SIH, SIL] latched by each of m latch circuits 224. The decoder 226 outputs a selection signal S1 every period T1 and T2 defined by the latch signal LAT and the change signal CH1, and outputs a selection signal S2 every period T3 and T4 defined by the latch signal LAT and the change signal CH2.

Figures 6, 7:
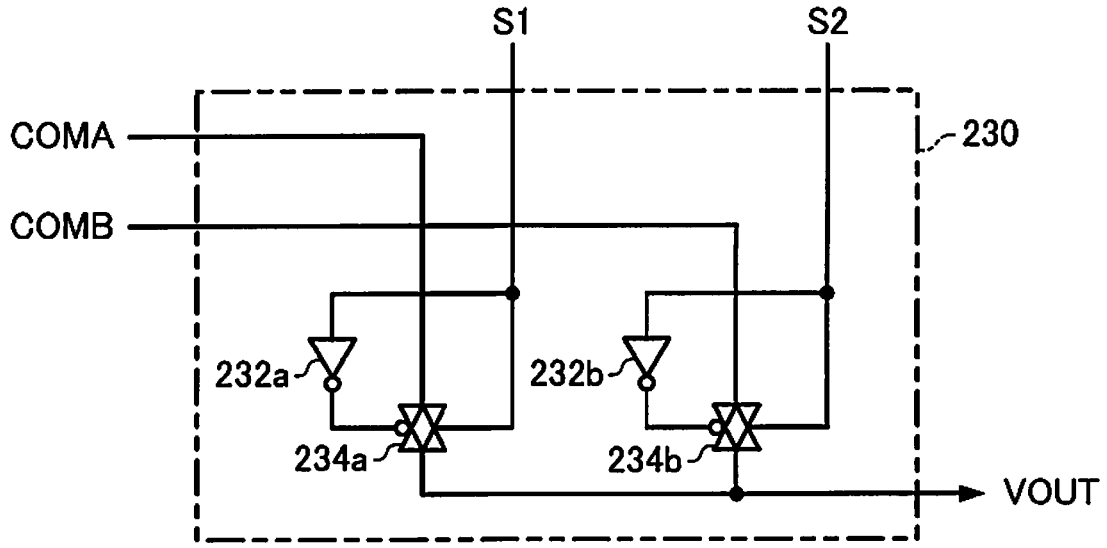
FIG. 6 is a table illustrating the contents of decoding in the decoder.
FIG. 7 is a diagram illustrating a configuration of a selection circuit corresponding to one discharge portion.

FIG. 6 is a table illustrating the contents of decoding in the decoder 226. When the N-charge signal NCHG is at the L level, the decoder 226 outputs the selection signals S1 and S2 in accordance with the latched 2-bit print data [SIH, SIL]. For example, when the N-charge signal NCHG is at the L level and the latched 2-bit print data [SIH, SIL] is [1, 0], the decoder 226 outputs the selection signal S1 at H and L levels in the periods T1 and T2, respectively, and the selection signal S2 at L and H levels in the periods T3 and T4, respectively. In addition, when the N-charge signal NCHG is at the H level, the decoder 226 outputs the selection signal S1 as the H level and the selection signal S2 as the L level regardless of the print data [SIH, SIL] and the period Ta. The selection signals S1 and S2 are level-shifted to high amplitude logic based on the high voltage signal VHV by a level shifter (not illustrated).

The selection circuit 230 is provided corresponding to each of the discharge portions 600. That is, the number of selection circuits 230 included in the drive signal selection circuit 200 is the same as the total number m of the corresponding discharge portions 600.

FIG. 7 is a diagram illustrating the configuration of the selection circuit 230 corresponding to one discharge portion 600. As illustrated in FIG. 7, the selection circuit 230 includes inverters 232*a* and 232*b* which are NOT circuits, and transfer gates 234*a* and 234*b*.

The selection signal S1 is supplied to a positive control terminal not marked with a circle in the transfer gate 234*a* while being logically inverted by the inverter 232*a* and supplied to a negative control terminal marked with a circle in the transfer gate 234*a*. In addition, the selection signal S2 is supplied to a positive control terminal of the transfer gate 234*b* while being logically inverted by the inverter 232*b* and supplied to a negative control terminal of the transfer gate 234*b*.

The drive signal COMA is supplied to an input terminal of the transfer gate 234*a*, and the drive signal COMB is supplied to an input terminal of the transfer gate 234*b*. Output terminals of the transfer gates 234*a* and 234*b* are commonly coupled, and the drive signal VOUT is output to the discharge portion 600 via a common coupling terminal.

The transfer gate 234*a* conducts (turns on) between the input terminal and the output terminal when the selection signal S1 is at the H level, and does not conduct (turn off) between the input terminal and the output terminal when the selection signal S1 is at the L level. The transfer gate 234*b* conducts between the input terminal and the output terminal when the selection signal S2 is at the H level, and does not conduct between the input terminal and the output terminal when the selection signal S2 is at the L level.

Here, as described above, the N-charge signal NCHG causes the decoder 226 to output the H-level selection signal S1 and the L-level selection signal S2 regardless of the print data [SIH, SIL] and the period Ta. That is, the n-charge signal NCHG is a signal for causing the transfer gate 234*a* to be forcibly conducted. The N-charge signal NCHG is used for the maintenance operation of the print head 21 or the like, for example. In the present embodiment, although the N-charge signal NCHG is at the L level when the liquid discharge apparatus 1 performs the printing operation, and at the H level when performing the maintenance operation, and the like, the disclosure is not limited thereto.

Figure 8:
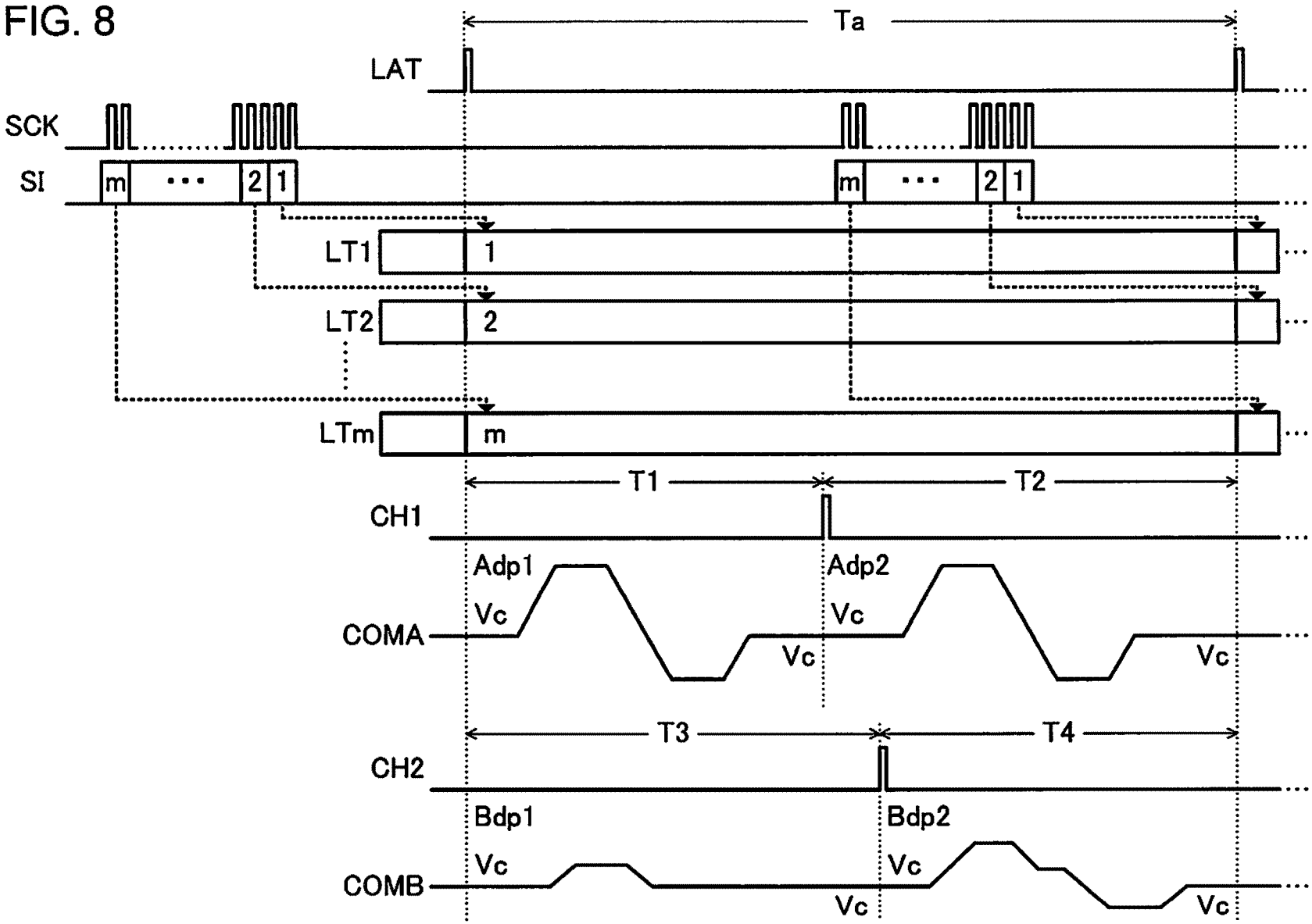
FIG. 8 is a diagram for describing an operation of the drive signal selection circuit.

Next, the operation of the drive signal selection circuit 200 will be described with reference to FIG. 8. FIG. 8 is a diagram for describing the operation of the drive signal selection circuit 200. The print data signal SI is serially supplied in synchronization with the clock signal SCK and sequentially transferred in the shift register 222 corresponding to the discharge portion 600. When the supply of the clock signal SCK is stopped, each shift register 222 holds the 2-bit print data [SIH, SIL] corresponding to each of the discharge portions 600. The print data signal SI is supplied in the order corresponding to the final m-th stage, second stage, and first stage of the discharge portion 600 in the shift register 222.

When the latch signal LAT rises, each of the latch circuits 224 simultaneously latches the 2-bit print data [SIH, SIL] held in the shift register 222. In FIG. 8, LT1, LT2, . . . , and LTm indicate the 2-bit print data [SIH, SIL] latched by the latch circuit 224 corresponding to the shift register 222 of first stage, second stage, . . . , and m-th stage.

The decoder 226 outputs the logic levels of the selection signals S1 and S2 with the contents as illustrated in FIG. 6 in each of the periods T1, T2, T3, and T4 in accordance with the size of the dot defined by the latched 2-bit print data [SIH, SIL].

Specifically, when the print data [SIH, SIL] is (1, 1), the decoder 226 sets the selection signal S1 to H and H levels in the periods T1 and T2, and sets the selection signal S2 to L and L levels in the periods T3 and T4. In this case, the selection circuit 230 selects the trapezoidal waveform Adp1 included in drive signal COMA in period T1, selects the trapezoidal waveform Adp2 included in drive signal COMA in period T2, does not select the trapezoidal waveform Bdp1 included in the drive signal COMB in the period T3, and does not select the trapezoidal waveform Bdp2 included in the drive signal COMB in the period T4. As a result, a drive signal VOUT corresponding to the "large dot" illustrated in FIG. 4 is generated.

In addition, when the print data [SIH, SIL] is [1, 0], the decoder 226 sets the selection signal S1 to H and L levels in the periods T1 and T2, and sets the selection signal S2 to L and H levels in the periods T3 and T4. In this case, the selection circuit 230 selects the trapezoidal waveform Adp1 included in drive signal COMA in period T1, does not select the trapezoidal waveform Adp2 included in drive signal COMA in period T2, does not select the trapezoidal waveform Bdp1 included in the drive signal COMB in the period T3, and selects the trapezoidal waveform Bdp2 included in the drive signal COMB in the period T4. As a result, a drive signal VOUT corresponding to the "medium dot" illustrated in FIG. 4 is generated.

In addition, when the print data [SIH, SIL] is [0, 1], the decoder 226 sets the selection signal S1 to L and L levels in the periods T1 and T2, and sets the selection signal S2 to L and H levels in the periods T3 and T4. In this case, the selection circuit 230 does not select the trapezoidal waveform Adp1 included in drive signal COMA in period T1, does not select the trapezoidal waveform Adp2 included in drive signal COMA in period T2, does not select the trapezoidal waveform Bdp1 included in drive signal COMB in period T3, and selects the trapezoidal waveform Bdp2 included in drive signal COMB in period T4. As a result, a drive signal VOUT corresponding to the "small dot" illustrated in FIG. 4 is generated.

In addition, when the print data [SIH, SIL] is [0, 0], the decoder 226 sets the selection signal S1 to L and L levels in the periods T1 and T2, and sets the selection signal S2 to H and L levels in the periods T3 and T4. In this case, the selection circuit 230 does not select the trapezoidal waveform Adp1 included in drive signal COMA in period T1, does not select the trapezoidal waveform Adp2 included in drive signal COMA in period T2, selects the trapezoidal waveform Bdp1 included in the drive signal COMB in the period T3, and does not select the trapezoidal waveform Bdp2 included in the drive signal COMB in the period T4. As a result, a drive signal VOUT corresponding to "non-recording" illustrated in FIG. 4 is generated.

As described above, the drive signal selection circuit 200 selects the drive signals COMA and COMB based on the print data signal SI, the latch signal LAT, the change signals CH1 and CH2, and the clock signal SCK, and outputs the drive signal VOUT. The drive signal selection circuit 200 may be configured as an integrated circuit (IC), for example.

5. Configuration and Operation of Temperature Abnormality Detection Circuit

Figure 9:
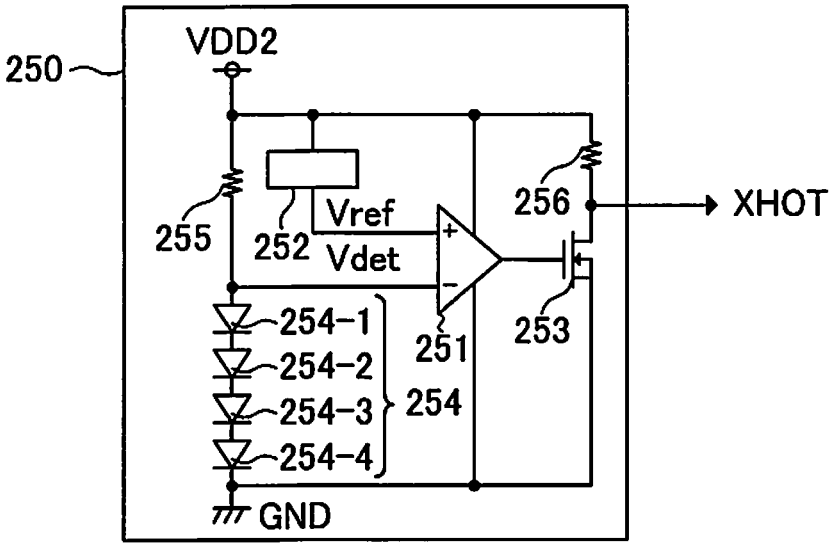
FIG. 9 is a diagram illustrating a configuration of a temperature abnormality detection circuit.

Next, the configuration and operation of the temperature abnormality detection circuit 250 will be described with reference to FIG. 9. FIG. 9 is a diagram illustrating the configuration of the temperature abnormality detection circuit 250. As illustrated in FIG. 9, the temperature abnormality detection circuit 250 includes a comparator 251, a reference voltage output circuit 252, a transistor 253, a plurality of diodes 254, and resistances 255 and 256.

The low voltage signal VDD2 is input to the reference voltage output circuit 252. The reference voltage output circuit 252 generates a voltage Vref by transforming the low voltage signal VDD2 and supplies the voltage Vref to a positive input terminal of the comparator 251. The reference voltage output circuit 252 includes a voltage regulator circuit, for example.

The plurality of diodes 254 are coupled in series to one another. The low voltage signal VDD2 is supplied to an anode terminal of the diode 254 located on the highest potential side among the plurality of diodes 254 coupled in series through the resistance 255, and the ground signal GND is supplied to a cathode terminal of the diode 254 located on the lowest potential side. Specifically, the temperature abnormality detection circuit 250 includes diodes 254-1, 254-2, 254-3, and 254-4 as the plurality of diodes 254. The low voltage signal VDD2 is supplied to the anode terminal of the diode 254-1 through the resistance 255, and the anode terminal of the diode 254-1 is coupled to a negative input terminal of the comparator 251. The cathode terminal of the diode 254-1 is coupled to the anode terminal of the diode 254-2. The cathode terminal of the diode 254-2 is coupled to the anode terminal of the diode 254-3. The cathode terminal of the diode 254-3 is coupled to the anode terminal of the diode 254-4. The ground signal GND is supplied to the cathode terminal of the diode 254-4. A voltage Vdet, which is the sum of the forward voltages of each of the plurality of diodes 254, is supplied to the negative input terminal of the comparator 251 by the resistance 255 and the plurality of diodes 254 configured as described above. The number of the plurality of diodes 254 included in the temperature abnormality detection circuit 250 is not limited to four.

The comparator 251 operates by the potential difference between the low voltage signal VDD2 and the ground signal GND. The comparator 251 compares the voltage Vref supplied to the positive input terminal with the voltage Vdet supplied to the negative input terminal, and outputs a signal based on the comparison result from an output terminal.

The low voltage signal VDD2 is supplied to a drain terminal of the transistor 253 through the resistance 256. In addition, a gate terminal of the transistor 253 is coupled to the output terminal of the comparator 251, and the ground signal GND is supplied to a source terminal. The voltage supplied to the drain terminal of the transistor 253 coupled as described above is output from the temperature abnormality detection circuit 250 as the abnormal signal XHOT.

The voltage value of the voltage Vref generated by the reference voltage output circuit 252 is smaller than the voltage Vdet when the temperatures of the plurality of diodes 254 are within the predetermined range. In this case, the comparator 251 outputs a signal at the L level. Therefore, the transistor 253 is controlled to be off, and as a result, the temperature abnormality detection circuit 250 outputs an abnormal signal XHOT at the H level.

The forward voltage of the diode 254 has the characteristic of decreasing as the temperature rises. Therefore, when a temperature abnormality occurs in the print head 21 or the drive signal selection circuit 200, the temperature of the diode 254 rises, and the voltage Vdet decreases accordingly. When the voltage Vdet falls below the voltage Vref due to the temperature rise, the output signal of the comparator 251 changes from the L level to the H level. Therefore, the transistor 253 is controlled to be on. As a result, the temperature abnormality detection circuit 250 outputs the abnormal signal XHOT at the L level. That is, the temperature abnormality detection circuit 250 outputs the low voltage signal VDD2 supplied as a pull-up voltage of the transistor 253 as the abnormal signal XHOT at the H level, and outputs the ground signal GND as the abnormal signal XHOT at the L level, when the transistor 253 is controlled to be on or off based on the temperature of the drive signal selection circuit 200.

6. Configuration of Print Head

Figure 10:
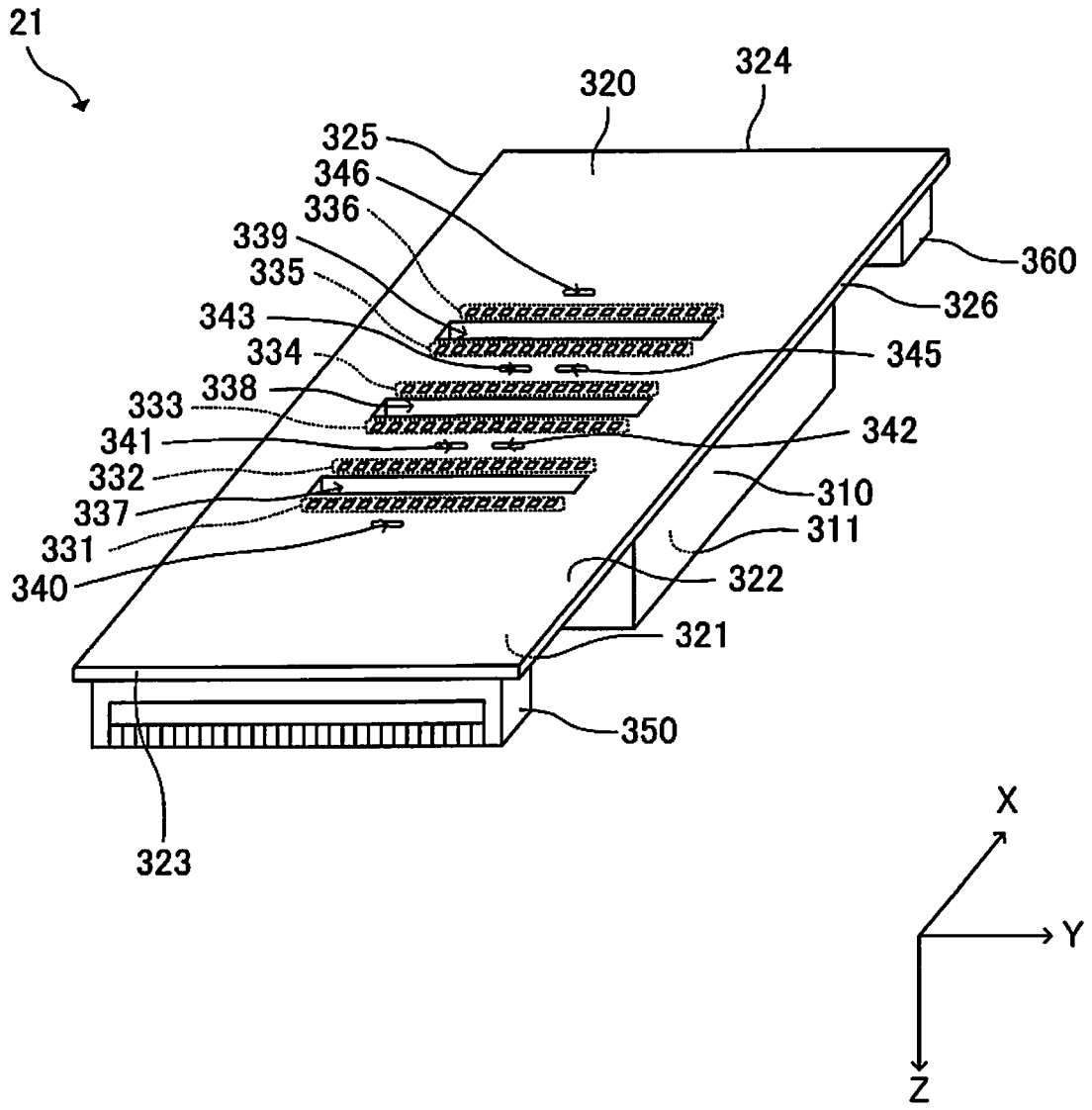
FIG. 10 is a perspective view illustrating a configuration of a print head.

Here, an example of the configuration of the print head 21 will be described with reference to FIG. 10. FIG. 10 is a perspective view illustrating the configuration of the print head 21. The print head 21 includes a head 310 and a head substrate 320. In addition, the head 310 includes an ink discharge surface 311 discharging the ink from the plurality of discharge portions 600.

Figure 11:
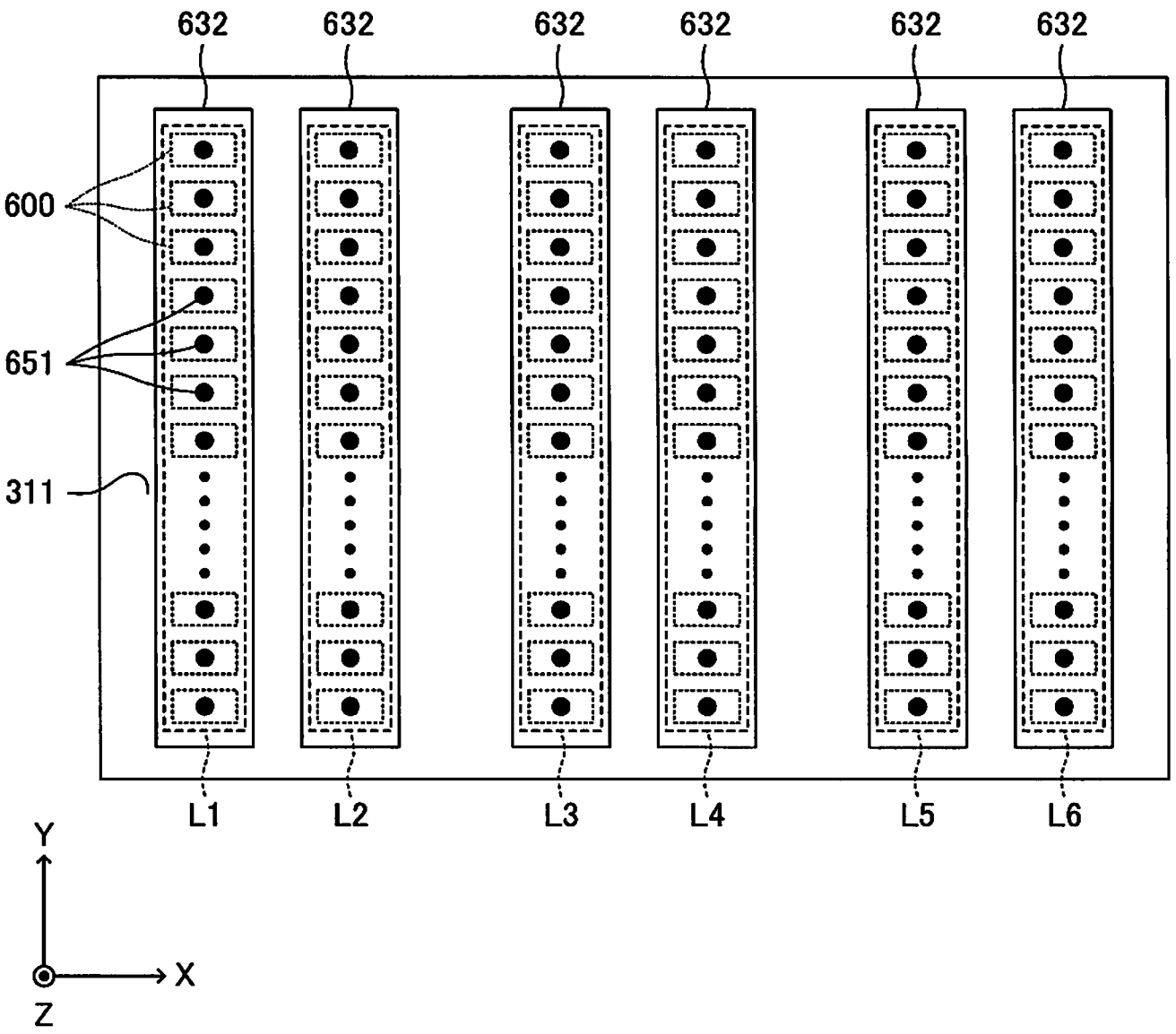
FIG. 11 is a plan view illustrating an ink discharge surface of a head.

FIG. 11 is a plan view illustrating the ink discharge surface 311 of the head 310. As illustrated in FIG. 11, six nozzle plates 632 are provided on the ink discharge surface 311 along the X direction. In each of the nozzle plates 632, nozzle rows L1 to L6 in which nozzles 651 are arranged along the Y direction are formed. In FIG. 11, although the nozzles 651 are arranged in parallel in one row in the nozzle rows L1 to L6 provided in each of the nozzle plates 632, the nozzles 651 may be arranged in parallel in two or more rows. Inks of different colors are supplied to the nozzle rows L1 to L6 formed on the ink discharge surface 311. The ink of the common color may be supplied to some of the nozzle rows L1 to L6.

Here, the discharge portion 600 provided corresponding to each of the drive signal selection circuits 200*a* to 200*f* described in FIG. 2 corresponds to the discharge portion 600 provided for each of the nozzle rows L1 to L6 illustrated in FIG. 11. Specifically, the drive signal VOUT1 output from the drive signal selection circuit 200*a* is supplied to one end of the piezoelectric element 60 included in the plurality of discharge portions 600 provided in the nozzle row L1, and the reference voltage signal CGND1 is supplied to the other end of the piezoelectric element 60. Similarly, the drive signal VOUT2 output from the drive signal selection circuit 200*b* is supplied to one end of the piezoelectric element 60 included in the plurality of discharge portions 600 provided in the nozzle row L2, and the reference voltage signal CGND2 is supplied to the other end of the piezoelectric element 60. Similarly, the drive signal VOUT3 output from the drive signal selection circuit 200*c* is supplied to one end of the piezoelectric element 60 included in the plurality of discharge portions 600 provided in the nozzle row L3, and the reference voltage signal CGND3 is supplied to the other end of the piezoelectric element 60. Similarly, the drive signal VOUT4 output from the drive signal selection circuit 200*d* is supplied to one end of the piezoelectric element 60 included in the plurality of discharge portions 600 provided in the nozzle row L4, and the reference voltage signal CGND4 is supplied to the other end of the piezoelectric element 60. Similarly, the drive signal VOUT5 output from the drive signal selection circuit 200*e* is supplied to one end of the piezoelectric element 60 included in the plurality of discharge portions 600 provided in the nozzle row L5, and the reference voltage signal CGND5 is supplied to the other end of the piezoelectric element 60. Similarly, the drive signal VOUT6 output from the drive signal selection circuit 200*f* is supplied to one end of the piezoelectric element 60 included in the plurality of discharge portions 600 provided in the nozzle row L6, and the reference voltage signal CGND6 is supplied to the other end of the piezoelectric element 60.

Figure 12:
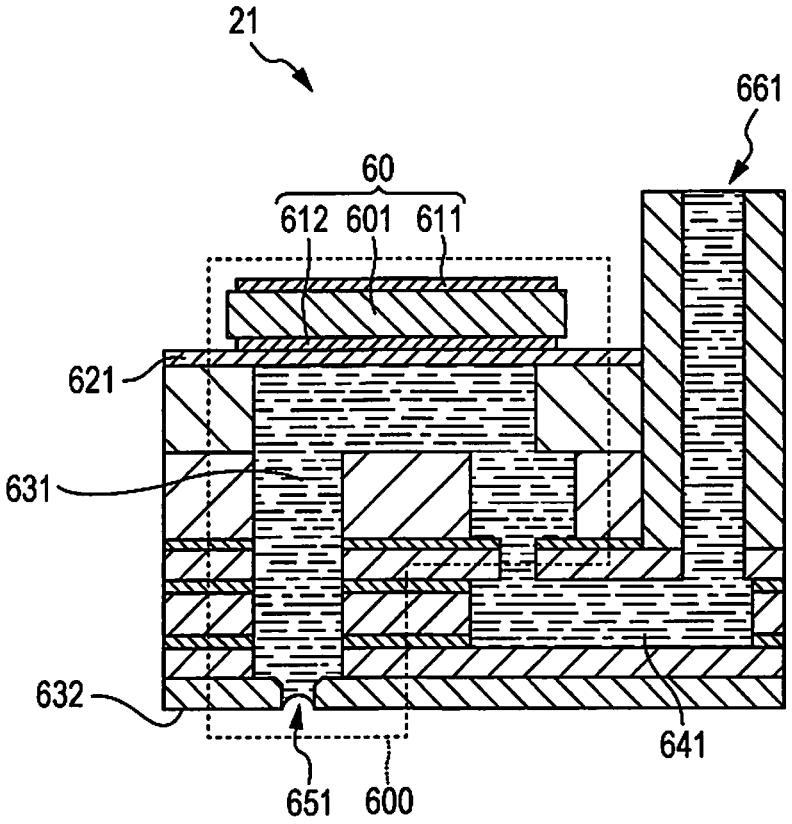
FIG. 12 is a diagram illustrating a schematic configuration of the discharge portion.

Next, the configuration of the discharge portion 600 will be described with reference to FIG. 12. FIG. 12 is a diagram illustrating a schematic configuration of one of the plurality of discharge portions 600 included in the print head 21. As illustrated in FIG. 12, the print head 21 includes the discharge portion 600, and a reservoir 641.

The reservoir 641 is provided for each color of ink. That is, the reservoir 641 is commonly provided in each of the nozzle rows L1 to L6. The ink is introduced into the reservoir 641 from an ink supply port 661.

The discharge portion 600 includes the piezoelectric element 60, a diaphragm 621, a cavity 631 functioning as a pressure chamber, and the nozzle 651. Among these, the diaphragm 621 is displaced by the piezoelectric element 60 provided on the upper surface in FIG. 12, and functions as a diaphragm that enlarges or reduces the internal volume of the cavity 631 filled with the ink. The nozzle 651 is an opening portion provided in the nozzle plate 632 and in communication with the cavity 631. The inside of the cavity 631 is filled with the ink, and the displacement of the piezoelectric element 60 changes the internal volume. The nozzle 651 communicates with the cavity 631 and discharges the ink inside the cavity 631 according to the change of the internal volume of the cavity 631.

The piezoelectric element 60 illustrated in FIG. 12 has a structure in which a piezoelectric body 601 is interposed between a pair of electrodes 611 and 612. In the piezoelectric body 601 of this structure, the central portions of the electrodes 611 and 612 and the diaphragm 621 are bent in a vertical direction in FIG. 12 with respect to both end portions, according to the voltage supplied to the electrodes 611 and 612. Specifically, when the voltage of the drive signal VOUT increases, the central portion of the piezoelectric element 60 is bent upward. On the other hand, when the voltage of the drive signal VOUT decreases, the central portion of the piezoelectric element 60 is bent downward. In this configuration, when the piezoelectric element 60 bends upward, the internal volume of the cavity 631 is expanded. Therefore, the ink is drawn from the reservoir 641. On the other hand, when the piezoelectric element 60 bends downward, the internal volume of the cavity 631 is reduced. Therefore, the ink corresponding to the degree of reduction is discharged from the nozzle 651.

The piezoelectric element 60 is not limited to the illustrated structure, and may be of any type that can deform the piezoelectric element 60 and discharge the ink such as ink. In addition, the piezoelectric element 60 is not limited to use flexural vibration, and may be configured to use longitudinal vibration.

Returning to FIG. 10, the head substrate 320 as an example of a substrate is a substantially rectangular circuit substrate having a surface 321 and a surface 322 different from the surface 321, a side 323, a side 324 facing the side 323 in the X direction, a side 325, and a side 326 facing the side 325 in the Y direction. Here, in the head substrate 320, the surface 321 and the surface 322 are the surfaces located facing each other through the base material of the head substrate 320, in other words, the surfaces 321 and 322 are the front and rear surfaces of the head substrate 320. The shape of the head substrate 320 is not limited to a rectangle, and, for example, may be a polygon such as a hexagon or an octagon, or a notch or an arc may be formed in part.

A first connector 350 and a second connector 360 are mounted on the surface 321 of the head substrate 320 to which the head 310 is coupled. In addition, on the surface 322 opposite to the surface 321 in the head substrate 320, coupling terminal groups 331 to 336 are formed. Furthermore, in the head substrate 320, FPC insertion holes 337 to 339 inserting the surface 321 and the surface 322, and ink supply path insertion holes 340 to 345 are formed.

The first connector 350 is provided along the side 323 of the head substrate 320. In addition, the second connector 360 is provided along the side 324 of the head substrate 320. A control signal Ctrl-H including a plurality of signals for controlling the print head 21 and a plurality of drive signals COM are input to the first connector 350 and the second connector 360. The control signal Ctrl-H and the plurality of drive signals COM are propagated to each of the coupling terminal groups 331 to 336 by wiring pattern (not illustrated) formed on the head substrate 320.

Specifically, the coupling terminal group 331 includes a plurality of electrodes arranged in parallel along the Y direction. The coupling terminal group 331 is supplied with a signal including the print data signal SI1, which controls the discharge of ink from the discharge portion 600 included in the nozzle row L1, the change signals CH1 and CH2, the latch signal LAT, the clock signal SCK, the drive signals COMA1 and COMB1, and the reference voltage signal CGND1.

Similarly, the coupling terminal group 332 includes a plurality of electrodes arranged in parallel along the Y direction on the side 324 of the coupling terminal group 331. The coupling terminal group 332 is supplied with a signal including the print data signal SI2, which controls the discharge of ink from the discharge portion 600 included in the nozzle row L2, the change signals CH1 and CH2, the latch signal LAT, the clock signal SCK, the drive signals COMA2 and COMB2, and the reference voltage signal CGND2.

Similarly, the coupling terminal group 333 includes a plurality of electrodes arranged in parallel along the Y direction on the side 324 of the coupling terminal group 332. The coupling terminal group 333 is supplied with a signal including the print data signal SI3, which controls the discharge of ink from the discharge portion 600 included in the nozzle row L3, the change signals CH1 and CH2, the latch signal LAT, the clock signal SCK, the drive signals COMA3 and COMB3, and the reference voltage signal CGND3.

Similarly, the coupling terminal group 334 includes a plurality of electrodes arranged in parallel along the Y direction on the side 324 side of the coupling terminal group 333. The coupling terminal group 334 is supplied with a signal including the print data signal SI4, which controls the discharge of ink from the discharge portion 600 included in the nozzle row L4, the change signals CH1 and CH2, the latch signal LAT, the clock signal SCK, the drive signals COMA4 and COMB4, and the reference voltage signal CGND4.

Similarly, the coupling terminal group 335 includes a plurality of electrodes arranged in parallel along the Y direction on the side 324 of the coupling terminal group 334. The coupling terminal group 335 is supplied with a signal including the print data signal SI5, which controls the discharge of ink from the discharge portion 600 included in the nozzle row L5, the change signals CH1 and CH2, the latch signal LAT, the clock signal SCK, the drive signals COMA5 and COMB5, and the reference voltage signal CGND5.

Similarly, the coupling terminal group 336 includes a plurality of electrodes arranged in parallel along the Y direction on the side 324 of the coupling terminal group 335. The coupling terminal group 336 is supplied with a signal including the print data signal SI6, which controls the discharge of ink from the discharge portion 600 included in the nozzle row L6, the change signals CH1 and CH2, the latch signal LAT, the clock signal SCK, the drive signals COMA6 and COMB6, and the reference voltage signal CGND6.

In addition, a flexible printed circuit (FPC) (not illustrated) is coupled to each of the coupling terminal groups 331 to 336. The signal supplied to each of the coupling terminal groups 331 to 336 described above is an example, and a signal may be supplied according to the arrangement of the nozzle rows L1 to L6 provided in the head 310, the structure of the FPC, or the like.

The FPC insertion hole 337 is formed between the coupling terminal group 331 and the coupling terminal group 332 in the X direction. The FPC coupled to each of the coupling terminal groups 331 and 332 is inserted into the FPC insertion hole 337, and is electrically coupled to the plurality of piezoelectric elements 60 included in each of the nozzle rows L1 and L2 provided in the head 310.

The FPC insertion hole 338 is formed between the coupling terminal group 333 and the coupling terminal group 334 in the X direction. The FPC coupled to each of the coupling terminal groups 333 and 334 is inserted into the FPC insertion hole 338, and is electrically coupled to the plurality of piezoelectric elements 60 included in each of the nozzle rows L3 and L4 provided in the head 310.

The FPC insertion hole 339 is formed between the coupling terminal group 335 and the coupling terminal group 336 in the X direction. The FPC coupled to each of the coupling terminal groups 335 and 336 is inserted into the FPC insertion hole 339, and is electrically coupled to the plurality of piezoelectric elements 60 included in each of the nozzle rows L5 and L6 provided in the head 310.

Here, although not illustrated, each of the drive signal selection circuits 200*a* to 200*f* included in the print head 21 is chip on film (COF) mounted on the FPC coupled to each of the coupling terminal groups 331 to 336, and may be provided inside the head 310.

A portion of an ink supply path (not illustrated) supplying the ink to the ink supply port 661 to which the ink discharged from the nozzle row L1 is supplied is inserted into the ink supply path insertion hole 340. Similarly, a portion of an ink supply path (not illustrated) supplying the ink to the ink supply port 661 to which the ink discharged from each of the nozzle rows L2, L3, L4, L5, and L6 is supplied is inserted into each of the ink supply path insertion holes 341 to 345.

Next, the configuration of the first connector 350 and the second connector 360 mounted on the head substrate 320 will be described with reference to FIGS. 13 and 14.

Figure 13:
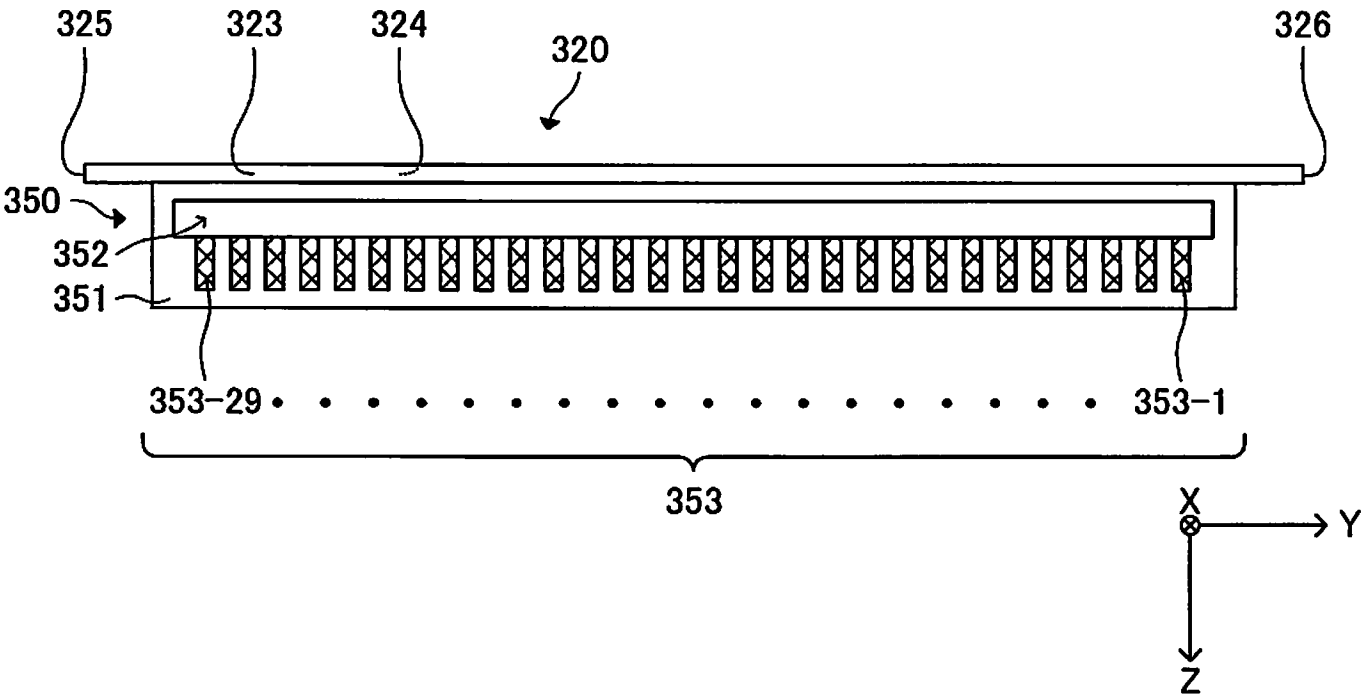
FIG. 13 is a diagram illustrating a configuration of a first connector.

FIG. 13 is a diagram illustrating the configuration of the first connector 350. The first connector 350 includes a housing 351, a cable attachment portion 352, and a plurality of terminals 353. The plurality of terminals 353 are arranged in parallel in the Y direction. When a cable electrically coupled to the control mechanism 10 is attached to the cable attachment portion 352, each of the plurality of terminals included in the cable is electrically coupled to each of the plurality of terminals 353. In the first connector 350 of this embodiment, 29 terminals 353 are arranged in parallel along the Y direction. In the following description, the 29 terminals 353 arranged in parallel may be referred to as terminals 353-1, 353-2, . . . , 353-29 in order from the side 326 to the side 325.

Figure 14:
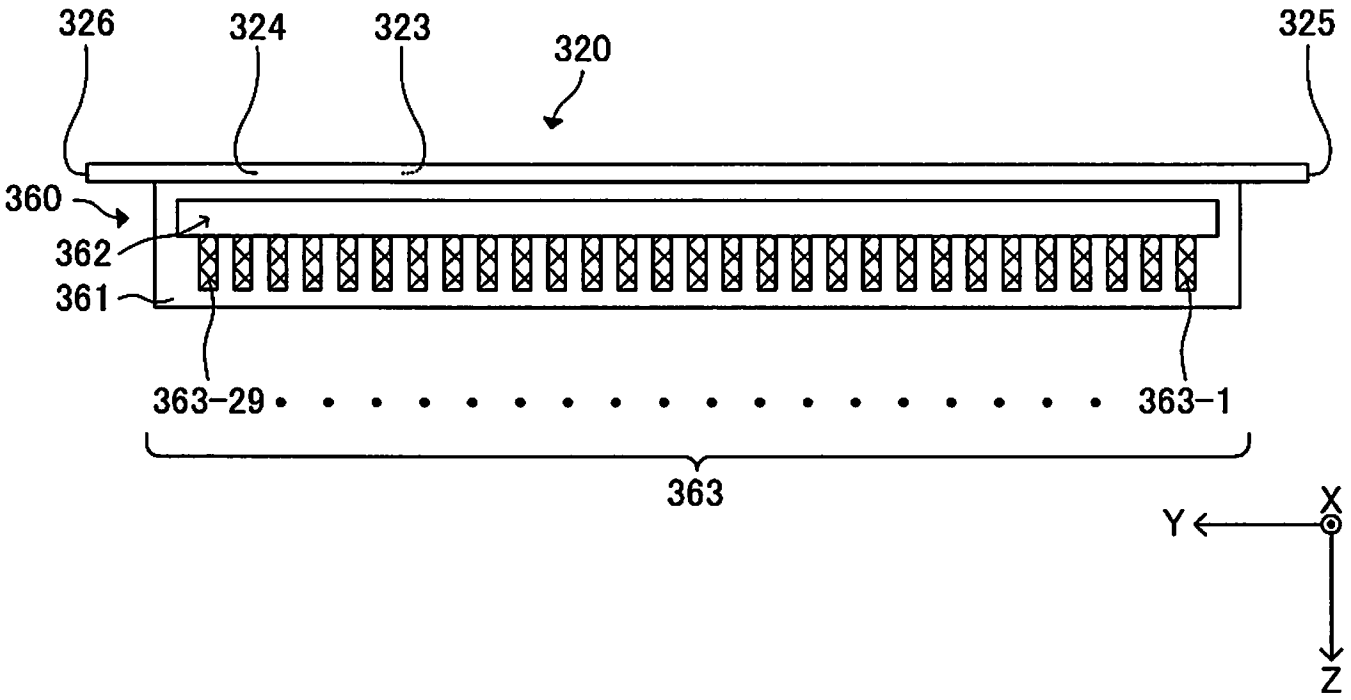
FIG. 14 is a diagram illustrating a configuration of a second connector.

FIG. 14 is a diagram illustrating the configuration of the second connector 360. The second connector 360 includes a housing 361, a cable attachment portion 362, and a plurality of terminals 363. The plurality of terminals 363 are arranged in parallel in the Y direction. When a cable electrically coupled to the control mechanism 10 is attached to the cable attachment portion 362, each of the plurality of terminals included in the cable is electrically coupled to each of the plurality of terminals 363. In the second connector 360 of this embodiment, 29 terminals 363 are arranged in parallel along the Y direction. In the following description, 29 terminals 363 arranged in parallel may be referred to as terminals 363-1, 363-2, . . . , 363-29 in order from the side 325 to the side 326.

The print head 21 configured as described above has a function of performing self-diagnosis according to a diagnostic signal to be input. The self-diagnosis function is a function to self-diagnose whether the print head 21 is normal or not, and for example, is a function to determine by the print head 21 itself whether it is possible to form dots satisfying a normal print quality and to discharge the ink, based on the diagnostic signal input from the control circuit 100 of the control mechanism 10 to the print head 21.

For example, it is preferable that such self-diagnosis is performed in a non-printing state such as a case in which the liquid discharge apparatus 1 is powered on, a case in which shutdown processing of the liquid discharge apparatus 1 is performed, a case in which an instruction to start printing or an instruction to end printing occurs, or the like. In addition, the self-diagnosis in a case in which the power of the liquid discharge apparatus 1 is continuously turned on and the non-printing state continues may be performed periodically or irregularly. Such self-diagnosis is performed based on the diagnostic signal input from the first connector 350 and the second connector 360.

For example, the print head 21 may check a coupling between the print head 21 and the control mechanism 10 as a self-diagnosis, depending on whether or not the voltage level of the input diagnostic signal is normal. In addition, for example, the print head 21 may check the operation of various configurations included in the print head 21 as a self-diagnosis, by operating an any configuration such as the drive signal selection circuit 200 and the piezoelectric element 60 included in the print head 21 and detecting a voltage signal resulting from the operation, depending on the combination of logic levels of the input diagnostic signal. In addition, the print head 21 may check the operation of any configuration of the drive signal selection circuit 200 and the piezoelectric element 60 included in the print head 21 as self-diagnosis, according to a predetermined command included in the input diagnostic signal, for example. The print head 21 may perform self-diagnosis other than the above.

7. Configuration of Print Head Control Circuit

Figure 15:
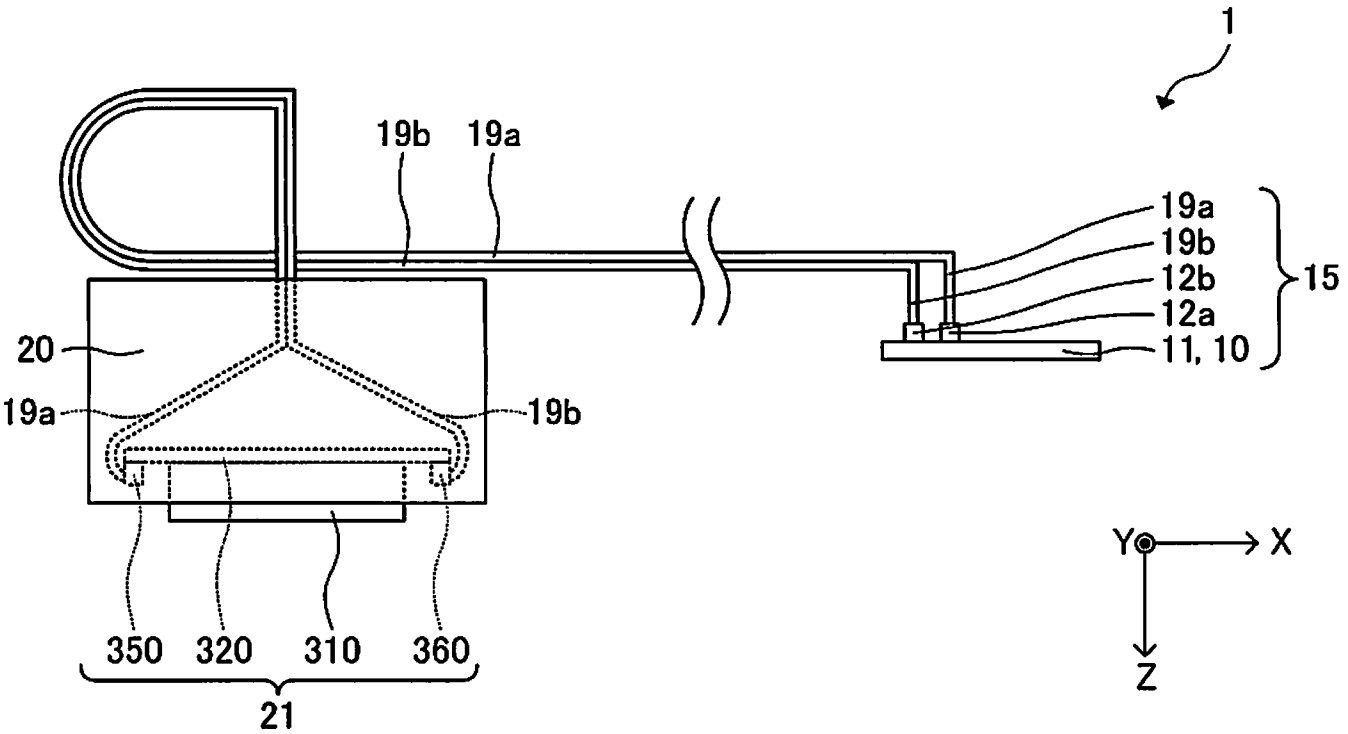
FIG. 15 is a diagram schematically illustrating an internal configuration when the liquid discharge apparatus is viewed from a Y direction.

FIG. 15 is a diagram schematically illustrating an internal configuration when the liquid discharge apparatus 1 is viewed from the Y direction. As illustrated in FIG. 15, the liquid discharge apparatus 1 includes a main substrate 11, a first cable 19*a*, a second cable 19*b*, and the print head 21.

Various circuits including the drive signal output circuit 50 included in the control mechanism 10 illustrated in FIGS. 1 and 2, and the control circuit 100 outputting various signals such as the control signal Ctrl-H and the diagnostic signal are mounted on the main substrate 11. A third connector 12*a* and a fourth connector 12*b* are mounted on the main substrate 11. Although one circuit substrate is illustrated as the main substrate 11 in FIG. 15, the main substrate 11 may include two or more circuit substrates. One end of the first cable 19*a* is attached to the third connector 12*a*. In addition, one end of the second cable 19*b* is attached to the fourth connector 12*b*.

The print head 21 includes the head 310, the head substrate 320, the first connector 350, and the second connector 360 as described above. The other end of the first cable 19*a* is attached to the first connector 350. In addition, the other end of the second cable 19*b* is attached to the second connector 360.

The liquid discharge apparatus 1 configured as described above controls the operation of the print head 21 having the self-diagnosis function, based on various signals such as the plurality of drive signals COM, the control signal Ctrl-H, and the plurality of diagnostic signals output from the control mechanism 10 mounted on the main substrate 11. That is, in the liquid discharge apparatus 1 illustrated in FIG. 15, an example of the print head control circuit 15 controlling the operation of the print head 21 having the self-diagnosis function is a configuration including the main substrate 11 on which the control mechanism 10 outputting various signals such as the plurality of drive signals COM, the control signal Ctrl-H, and the plurality of diagnostic signals for controlling the operation of the print head 21 is mounted, and the first cable 19*a* and the second cable 19*b* propagating various signals such as the plurality of drive signals COM, the control signal Ctrl-H, and the plurality of diagnostic signals for controlling the operation of the print head 21. In addition, in the print head control circuit 15, the control circuit 100 which generates a plurality of diagnostic signals is an example of a diagnostic signal output circuit.

Here, the configuration of the first cable 19*a* and the second cable 19*b* will be described with reference to FIG. 16. In the present embodiment, the first cable 19*a* and the second cable 19*b* have the same configuration as each other.

Therefore, in FIG. 16, the first cable 19*a* and the second cable 19*b* will be referred to as the cable 19 and will be described. FIG. 16 is a diagram illustrating the configuration of the cable 19. The cable 19 is a substantially rectangular shape having short sides 191 and 192 facing each other and long sides 193 and 194 facing each other, and is a flexible flat cable (FFC), for example.

On the short side 191 of the cable 19, 29 terminals 195-1 to 195-29 are provided side by side from the long side 193 side toward the long side 194 side along the short side 191. In addition, on the short side 192 side of the cable 19, 29 terminals 196-1 to 196-29 are provided side by side from the long side 193 side toward the long side 194 side along the short side 192. In addition, in the cable 19, 29 wiring 197-1 to 197-29 electrically coupling each of the 29 terminals 195-1 to 195-29 with each of the 29 terminals 196-1 to 196-29 are provided side by side from the long side 193 side toward the long side 194 side. Specifically, the wiring 197-*i* (i is any of 1 to 29) electrically couples the terminal 195-*i* and the terminal 196-*i*.

Each of the wiring 197-1 to 197-29 is insulated, by an insulator 198, between the wiring each other and between the wiring and the outside of the cable 19. For example, in the cable 19, various signals input from the terminal 195-*i* are propagated through the wiring 197-*i* and output to the head substrate 320 from the terminal 196-*i*. The configuration of the cable 19 illustrated in FIG. 16 is an example, and the present disclosure is not limited to this. For example, 29 terminals 195-1 to 195-29 and 29 terminals 196-1 to 196-29 may be provided on different sides of the cable 19. In addition, for example, 29 terminals 195-1 to 195-29 and 29 terminals 196-1 to 196-29 may be provided on both the front surface and the rear surface of the cable 19.

Figure 16:
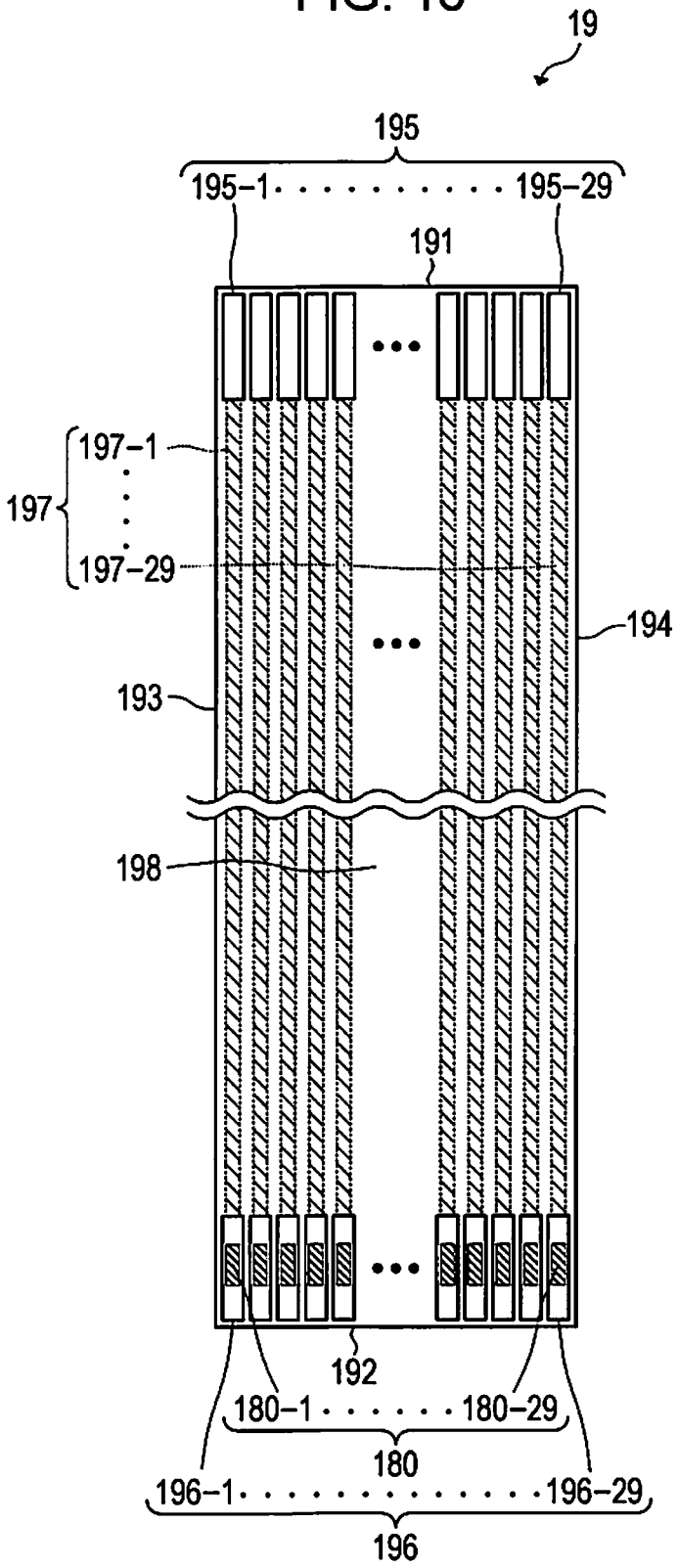
FIG. 16 is a diagram illustrating a configuration of a cable.
Figure 17:
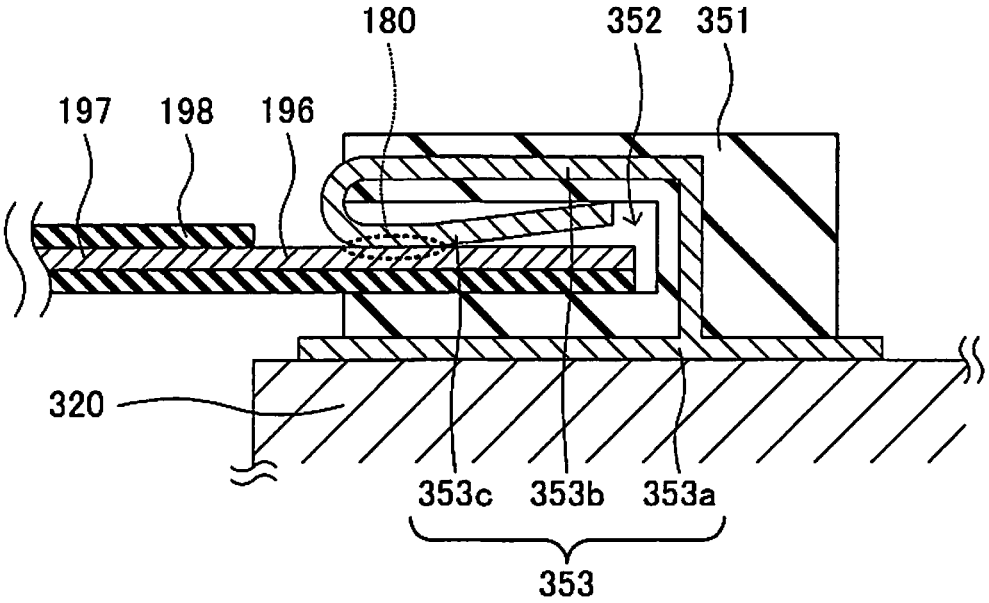
FIG. 17 is a diagram for describing a contact portion when the cable is attached to the first connector.

In addition, FIG. 16 illustrates a contact portion 180 in which the terminal 196 and the terminal 353 of the first connector 350 or the terminal 363 of the second connector 360 provided on the head substrate 320 are in contact with each other. FIG. 17 is a diagram for describing the contact portion 180 when the cable 19 is attached to the first connector 350. The first connector 350 and the second connector 360 have the same configuration as each other. Therefore, in FIG. 17, the case where the cable 19 is attached to the first connector 350 will be described, and the description of the case where the cable 19 is attached to the second connector 360 will not be repeated.

As illustrated in FIG. 17, the terminal 353 of the first connector 350 includes a substrate attachment portion 353*a*, a housing insertion portion 353*b*, and a cable holding portion 353*c*. The substrate attachment portion 353*a* is located below the first connector 350 and provided between the housing 351 and the head substrate 320. The substrate attachment portion 353*a* is electrically coupled to an electrode (not illustrated) provided on the head substrate 320 by solder, for example. The housing insertion portion 353*b* penetrates the inside of the housing 351. The housing insertion portion 353*b* electrically couples the substrate attachment portion 353*a* and the cable holding portion 353*c*. The cable holding portion 353*c* has a curved shape that protrudes inside the cable attachment portion 352. When the cable 19 is attached to the cable attachment portion 352, the cable holding portion 353*c* and the terminal 196 are in electrical contact with each other. As a result, the cable 19, the first connector 350, and the head substrate 320 are electrically coupled. In this case, by attaching the cable 19, stress is generated in the curved shape formed in the cable holding portion 353*c*. The cable 19 is held inside the cable attachment portion 352 by the stress. The contact portion 180 is a contact point in which the terminal 196 and the cable holding portion 353*c* are electrically coupled.

The shape of the first connector 350 is not limited to the above-described shape. The first connector 350 may have any shape as long as the first connector 350 can hold the cable 19 and propagate the signal propagated through the cable 19 to the head substrate 320. For example, the first connector 350 may have a lock mechanism, and the cable 19 and the first connector 350 may be electrically coupled in accordance with the operation of the lock mechanism while the cable 19 is held by the lock mechanism. That is, the contact portion 180 is a contact point in which the cable 19 included in the print head control circuit 15 and the print head 21 are in electrical contact with each other, and in other words, an output point in which the print head control circuit 15 outputs various control signals to the print head 21.

In the following description, the contact portion 180 in which the terminals 196-1 to 196-24 contact with the first connector 350 or the second connector 360 may be referred to as contact portions 180-1 to 180-24, respectively.

Next, details of the signals propagated through the first cable 19*a* and the second cable 19*b* will be described with reference to FIGS. 18 and 19. In description of FIGS. 18 and 19, the terminals 195-*i* and 196-*i*, the wiring 197-*i*, and the contact portion 180-*i* provided in the first cable 19*a* are referred to as terminals 195*a*-*i* and 196*a*-*i*, wiring 197*a*-*i*, and a contact portion 180*a*-*i*, respectively. Similarly, the terminals 195-*i* and 196-*i*, the wiring 197-*i*, and the contact portion 180-*i* provided in the second cable 19*b* are referred to as terminals 195*b*-*i* and 196*b*-*i*, wiring 197*b*-*i*, and a contact portion 180*b*-*i*, respectively. In addition, the terminals 195*a*-*i* and 195*b*-*i* are attached to the third connector 12*a* and the fourth connector 12*b*, respectively, and each of the terminals 196*a*-*i* and 196*b*-*i* is attached so as to be electrically coupled to each of the terminals 353-*i* and 363-*i* of the first connector 350 and the second connector 360 through the contact portions 180*a*-*i* and 180*b*-*i*.

First, the details of the signal propagated through the first cable 19*a* will be described with reference to FIG. 18. FIG. 18 is a table for describing the details of the signal propagated through the first cable 19*a*. As illustrated in FIG. 18, the first cable 19*a* includes a first wiring group 81 as an example of a first drive signal wiring group, a second wiring group 82 as an example of a first diagnostic signal wiring group, and a third wiring group 83 as an example of a second drive signal wiring group. The first wiring group 81 electrically contacts the print head 21 through a first wiring contact group 91. In addition, the second wiring group 82 electrically contacts the print head 21 through a second wiring contact group 92. In addition, the third wiring group 83 electrically contacts the print head 21 through a third wiring contact group 93. Here, the first wiring contact group 91 in which the first wiring group 81 electrically contacts the print head 21 is an example of a first drive signal contact group. The third wiring contact group 93 in which the third wiring group 83 electrically contacts the print head 21 is an example of a second drive signal contact group.

The first wiring group 81 includes wiring 197*a*-24 to 197*a*-29. In addition, the first wiring contact group 91 includes contact portions 180*a*-24 to 180*a*-29. The drive signal COMA1 supplied to one end of the piezoelectric element 60 included in the nozzle row L1 is propagated to the wiring 197*a*-25. The drive signal COMA1 is supplied to the print head 21 through the contact portion 180*a*-25. The reference voltage signal CGND1 supplied to the other end of the piezoelectric element 60 included in the nozzle row L1 is propagated to the wiring 197*a*-24. The reference voltage signal CGND1 is supplied to the print head 21 through the contact portion 180*a*-24. The drive signal COMB2 supplied to one end of the piezoelectric element 60 included in the nozzle row L2 is propagated to the wiring 197*a*-27. The drive signal COMB2 is supplied to the print head 21 through the contact portion 180*a*-27. The reference voltage signal CGND2 supplied to the other end of the piezoelectric element 60 included in the nozzle row L2 is propagated to the wiring 197*a*-26. The reference voltage signal CGND2 is supplied to the print head 21 through the contact portion 180*a*-26. The drive signal COMA3 supplied to one end of the piezoelectric element 60 included in the nozzle row L3 is propagated to the wiring 197*a*-29. The drive signal COMA3 is supplied to the print head 21 through the contact portion 180*a*-29. The reference voltage signal CGND3 supplied to the other end of the piezoelectric element 60 included in the nozzle row L3 is propagated to the wiring 197*a*-28. The reference voltage signal CGND3 is supplied to the print head 21 through the contact portion 180*a*-28.

As described above, the first wiring group 81 propagates at least one of the drive signal COMA and the drive signal COMB for causing the print head 21 to discharge the ink. The signal of at least one of the drive signal COMA and the drive signal COMB propagated through the first wiring group 81 is supplied to the print head 21 through the first wiring contact group 91.

Such a first wiring group 81 is configured to include the wiring adjacent to each other in the first cable 19*a*. That is, the first wiring group 81 is a collection of a plurality of wiring including wiring for propagating at least one of the drive signal COMA and the drive signal COMB, which are high voltage signals for driving the plurality of piezoelectric elements 60 included in the print head 21. The plurality of wiring included in the first wiring group 81 are provided adjacent to each other in the first cable 19*a*.

In addition, similarly, the first wiring contact group 91 is a collection of the plurality of contact portions in which the first wiring group 81 and the print head 21 are in electrical contact with each other, and for supplying the print head 21 with at least one of the drive signal COMA and the drive signal COMB, which are high voltage signals for driving the plurality of piezoelectric elements 60 included in the print head 21. The plurality of contact portions included in the first wiring contact group 91 are provided adjacent to each other in the plurality of contact portions in which the first cable 19*a* and the first connector 350 are in electrical contact with each other.

When the first cable 19*a* including the first wiring group 81 configured as described above is attached to the first connector 350 through the first wiring contact group 91, each of the terminals 196*a*-24 to 196*a*-29 of the first cable 19*a* is electrically coupled to each of terminals 353-24 to 353-29 of the first connector 350 through the contact portions 180*a*-24 to 180*a*-29. As a result, each of the drive signals COMA1, COMB2, and COMA3 and reference voltage signals CGND1, CGND2, and CGND3 propagated through the wiring 197*a*-24 to 197*a*-29 is supplied to the print head 21.

The third wiring group 83 includes wiring 197*a*-1 to 197*a*-6. In addition, the third wiring contact group 93 includes contact portions 180*a*-1 to 180*a*-6. The drive signal COMB1 supplied to one end of the piezoelectric element 60 included in the nozzle row L1 is propagated to the wiring 197*a*-6. The drive signal COMB1 is supplied to the print head 21 through the contact portion 180*a*-6. The reference voltage signal CGND1 supplied to the other end of the piezoelectric element 60 included in the nozzle row L1 is propagated to the wiring 197*a*-5. The reference voltage signal CGND1 is supplied to the print head 21 through the contact portion 180*a*-5. The drive signal COMA2 supplied to one end of the piezoelectric element 60 included in the nozzle row L2 is propagated to the wiring 197*a*-4. The drive signal COMA2 is supplied to the print head 21 through the contact portion 180*a*-4. The reference voltage signal CGND2 supplied to the other end of the piezoelectric element 60 included in the nozzle row L2 is propagated to the wiring 197*a*-3. The reference voltage signal CGND2 is supplied to the print head 21 through the contact portion 180*a*-3. The drive signal COMB3 supplied to one end of the piezoelectric element 60 included in the nozzle row L3 is propagated to the wiring 197*a*-2. The drive signal COMB3 is supplied to the print head 21 through the contact portion 180*a*-2. The reference voltage signal CGND3 supplied to the other end of the piezoelectric element 60 included in the nozzle row L3 is propagated to the wiring 197*a*-1. The reference voltage signal CGND3 is supplied to the print head 21 through the contact portion 180*a*-1.

As described above, the third wiring group 83 propagates at least one of the drive signal COMA and the drive signal COMB for causing the print head 21 to discharge the ink. The signal of at least one of the drive signal COMA and the drive signal COMB propagated through the third wiring group 83 is supplied to the print head 21 through the third wiring contact group 93.

Such a third wiring group 83 is configured to include the wiring adjacent to each other in the first cable 19*a*. That is, the third wiring group 83 is a collection of a plurality of wiring including wiring for propagating at least one of the drive signal COMA and the drive signal COMB, which are high voltage signals for driving the plurality of piezoelectric elements 60 included in the print head 21. The plurality of wiring included in the third wiring group 83 are provided adjacent to each other in the first cable 19*a*.

In addition, similarly, the third wiring contact group 93 is a collection of the plurality of contact portions in which the third wiring group 83 and the print head 21 are in electrical contact with each other, and for supplying the print head 21 with at least one of the drive signal COMA and the drive signal COMB, which are high voltage signals for driving the plurality of piezoelectric elements 60 included in the print head 21. The plurality of contact portions included in the third wiring contact group 93 are provided adjacent to each other in the plurality of contact portions in which the first cable 19*a* and the first connector 350 are in electrical contact with each other.

When the first cable 19*a* including the third wiring group 83 configured as described above is attached to the first connector 350 through the third wiring contact group 93, each of the terminals 196*a*-1 to 196*a*-6 of the first cable 19*a* is electrically coupled to each of the terminals 353-1 to 353-6 of the first connector 350 through the contact portions 180*a*-1 to 180*a*-6. As a result, each of the drive signals COMB1, COMA2, and COMB3 and reference voltage signals CGND1, CGND2, and CGND3 propagated through the wiring 197*a*-1 to 197*a*-6 is supplied to the print head 21.

Here, each of the wiring 197*a*-25 and 197*a*-29 which is included in the first wiring group 81 and propagates the drive signals COMA1 and COMA3 is an example of a first drive signal propagation wiring. The wiring 197*a*-6 and 197*a*-2 which are included in the third wiring group 83 and propagate the drive signals COMB1 and COMB3 are examples of a second drive signal propagation wiring. In addition, the wiring 197*a*-27 which is included in the first wiring group 81 and propagates the driving signal COMB2 is another example of the first driving signal propagation wiring. The wiring 197*a*-4 which is included in the third wiring group 83 and propagates the drive signal COMA2 is another example of the second drive signal propagation wiring.

The second wiring group 82 includes wiring 197*a*-7 to 197*a*-22. In addition, the second wiring contact group 92 includes contact portions 180*a*-7 to 180*a*-22. Although the latch signal LAT and a first diagnostic signal DIG1 may be propagated through different wiring, as illustrated in FIG. 18, it is preferable that the latch signal LAT and the first diagnostic signal DIG1 for performing self-diagnosis of the print head 21 are propagated through the common wiring 197*a*-21. In other words, it is preferable that the wiring 197*a*-21 also serves as wiring for propagating the first diagnostic signal DIG1 and wiring for propagating the latch signal LAT. In the non-printing state, the latch signal LAT is not propagated through the wiring 197*a*-21. On the other hand, since the self-diagnosis of the print head 21 is performed in the non-printing state, the first diagnostic signal DIG1 is propagated through the wiring 197*a*-21 in the non-printing state. Therefore, the latch signal LAT and the first diagnostic signal DIG1 can be propagated through the common wiring 197*a*-21. As a result, the number of wiring included in the first cable 19*a* can be reduced.

In addition, similarly, as illustrated in FIG. 18, it is preferable that the wiring for propagating the latch signal LAT, and the wiring for propagating the first diagnostic signal DIG1 for performing self-diagnosis of the print head 21 are in electrical contact with the common contact portion 180*a*-21. In other words, it is preferable that the contact portion 180*a*-21 also serves as a contact portion in electrical contact with the wiring for propagating the first diagnostic signal DIG1 and a contact portion in electrical contact with the wiring for propagating the latch signal LAT. In the non-printing state, the latch signal LAT is not propagated through the wiring 197*a*-21. Therefore, the latch signal LAT is not supplied to the contact portion 180*a*-21. On the other hand, since the self-diagnosis of the print head 21 is performed in the non-printing state, the first diagnostic signal DIG1 is supplied to the contact portion 180*a*-21 in the non-printing state. Therefore, the latch signal LAT and the first diagnostic signal DIG1 can be supplied to the print head 21 through the common contact portion 180*a*-21. As a result, the number of contact portions in which the first cable 19*a* and the print head 21 are in electrical contact with each other can be reduced. Accordingly, the number of wiring included in the first cable 19*a* and the number of terminals of the first connector 350 can be reduced.

Furthermore, the latch signal LAT is an important signal for controlling the discharge timing of the ink in the liquid discharge apparatus 1, and when coupling failure occurs in the wiring through which the latch signal LAT is propagated and the contact portion, there is a possibility that the ink discharge accuracy may be deteriorated. The first diagnostic signal DIG1 and the latch signal LAT are propagated through the common wiring 197*a*-21 and are supplied to the print head 21 through the common contact portion 180*a*-21. Therefore, based on the result of the self-diagnosis of the print head 21, the coupling state of the wiring 197*a*-21 to which the latch signal LAT is propagated and the contact state of the contact portion 180*a*-21 can be confirmed. That is, by performing self-diagnosis of the print head 21 by the first diagnostic signal DIG1, the possibility that the ink discharge accuracy of the liquid discharge apparatus 1 may be deteriorated can be reduced. The wiring 197*a*-21 through which the first diagnostic signal DIG1 is propagated is an example of a first diagnostic signal propagation wiring, and the contact portion 180*a*-21 is an example of a first contact portion.

Although the change signal CH1 and a second diagnostic signal DIG2 may be propagated through different wiring, as illustrated in FIG. 18, it is preferable that the change signal CH1 and the second diagnostic signal DIG2 for performing self-diagnosis of the print head 21 are propagated through the common wiring 197*a*-17. In other words, it is preferable that the wiring 197*a*-17 also serves as wiring for propagating the second diagnostic signal DIG2 and wiring for propagating the change signal CH1. In the non-printing state, the change signal CH1 is not propagated through the wiring 197*a*-17. On the other hand, since the self-diagnosis of the print head 21 is performed in the non-printing state, the second diagnostic signal DIG2 is propagated through the wiring 197*a*-17 in the non-printing state. Therefore, the change signal CH1 and the second diagnostic signal DIG2 can be propagated through the common wiring 197*a*-17. As a result, the number of wiring included in the first cable 19*a* can be reduced.

In addition, similarly, as illustrated in FIG. 18, it is preferable that the wiring for propagating the change signal CH1, and the wiring for propagating the second diagnostic signal DIG2 for performing self-diagnosis of the print head 21 are in electrical contact with the common contact portion 180*a*-17. In other words, it is preferable that the contact portion 180*a*-17 also serves as a contact portion in electrical contact with the wiring for propagating the second diagnostic signal DIG2 and a contact portion in electrical contact with the wiring for propagating the change signal CH1. In the non-printing state, the change signal CH1 is not propagated through the wiring 197*a*-17. Therefore, the change signal CH1 is not supplied to the contact portion 180*a*-17. On the other hand, since the self-diagnosis of the print head 21 is performed in the non-printing state, the second diagnostic signal DIG2 is supplied to the contact portion 180*a*-17 in the non-printing state. Therefore, the change signal CH1 and the second diagnostic signal DIG2 can be supplied to the print head 21 through the common contact portion 180*a*-17. As a result, the number of contact portions in which the first cable 19*a* and the print head 21 are in electrical contact with each other can be reduced. Accordingly, the number of wiring included in the first cable 19*a* and the number of terminals of the first connector 350 can be reduced.

Furthermore, the change signal CH1 is an important signal for defining the waveform switching timing of drive signal COMA in the liquid discharge apparatus 1, and when coupling failure occurs in the wiring through which the change signal CH1 is propagated and the contact portion, there is a possibility that the ink discharge accuracy may be deteriorated. The second diagnostic signal DIG2 and the change signal CH1 are propagated through the common wiring 197*a*-17 and are supplied to the print head 21 through the common contact portion 180*a*-17. Therefore, based on the result of the self-diagnosis of the print head 21, the coupling state of the wiring 197*a*-17 to which the change signal CH1 is propagated and the contact state of the contact portion 180*a*-17 can be confirmed. That is, by performing self-diagnosis of the print head 21 by the second diagnostic signal DIG2, the possibility that the ink discharge accuracy of the liquid discharge apparatus 1 may be deteriorated can be reduced. The wiring 197*a*-17 through which the second diagnostic signal DIG2 is propagated is an example of a second diagnostic signal propagation wiring, and the contact portion 180*a*-17 is an example of a second contact portion.

The change signal CH2 defining the waveform switching timing of the trapezoidal waveform Bdp1 and the trapezoidal waveform Bdp2 included in the drive signal COMB is propagated to the wiring 197*a*-19. The change signal CH2 is supplied to the print head 21 through the contact portion 180*a*-19. The second diagnostic signal DIG2 may be propagated through the wiring 197*a*-19 through which the change signal CH2 is propagated, and may be supplied to the print head 21 through the contact portion 180*a*-19.

Although the print data signal SI1 and a third diagnostic signal DIG3 may be propagated through different wiring, as illustrated in FIG. 18, it is preferable that the print data signal SI1 and the third diagnostic signal DIG3 for performing self-diagnosis of the print head 21 are propagated through the common wiring 197*a*-14. In other words, it is preferable that the wiring 197*a*-14 also serves as wiring for propagating the third diagnostic signal DIG3 and wiring for propagating the print data signal SI1. In the non-printing state, the print data signal SI1 is not propagated through the wiring 197*a*-14. On the other hand, since the self-diagnosis of the print head 21 is performed in the non-printing state, the third diagnostic signal DIG3 is propagated through the wiring 197*a*-14 in the non-printing state. Therefore, the print data signal SI1 and the third diagnostic signal DIG3 can be propagated through the common wiring 197*a*-14. As a result, the number of wiring included in the first cable 19*a* can be reduced.

In addition, similarly, as illustrated in FIG. 18, it is preferable that the wiring for propagating the print data signal SI1, and the wiring for propagating the third diagnostic signal DIG3 for performing self-diagnosis of the print head 21 are in electrical contact with the common contact portion 180*a*-14. In other words, it is preferable that the contact portion 180*a*-14 also serves as a contact portion in electrical contact with the wiring for propagating the third diagnostic signal DIG3 and a contact portion in electrical contact with the wiring for propagating the print data signal SI1. In the non-printing state, the print data signal SI1 is not propagated through the wiring 197*a*-14. Therefore, the print data signal SI1 is not supplied to the contact portion 180*a*-14. On the other hand, since the self-diagnosis of the print head 21 is performed in the non-printing state, the third diagnostic signal DIG3 is supplied to the contact portion 180*a*-14 in the non-printing state. Therefore, the print data signal SI1 and the third diagnostic signal DIG3 can be supplied to the print head 21 through the common contact portion 180*a*-14. As a result, the number of contact portions in which the first cable 19*a* and the print head 21 are in electrical contact with each other can be reduced. Accordingly, the number of wiring included in the first cable 19*a* and the number of terminals of the first connector 350 can be reduced.

Furthermore, the print data signal SI1 is an important signal for defining the waveform selection of the drive signals COMA1 and COMB1 in the liquid discharge apparatus 1, and when coupling failure occurs in the wiring through which the print data signal SI1 is propagated and the contact portion, there is a possibility that the ink discharge accuracy may be deteriorated. The third diagnostic signal DIG3 and the print data signal SI1 are propagated through the common wiring 197*a*-14 and are supplied to the print head 21 through the common contact portion 180*a*-14. Therefore, based on the result of the self-diagnosis of the print head 21, the coupling state of the wiring 197*a*-14 to which the print data signal SI1 is propagated and the contact state of the contact portion 180*a*-14 can be confirmed. Therefore, based on self-diagnosis of the print head 21 by the third diagnostic signal DIG3, the possibility that the ink discharge accuracy of the liquid discharge apparatus 1 may be deteriorated can be reduced. The wiring 197*a*-14 through which the third diagnostic signal DIG3 is propagated is an example of a third diagnostic signal propagation wiring, and the contact portion 180*a*-14 is an example of a third contact portion.

The print data signal SI2 defining the waveform selection of the drive signals COMA2 and COMB2 supplied to the nozzle row L2 is propagated to the wiring 197*a*-8. The print data signal SI2 is supplied to the print head 21 through the contact portion 180*a*-8. In addition, the print data signal SI3 defining the waveform selection of the drive signals COMA3 and COMB3 supplied to the nozzle row L3 is propagated to the wiring 197*a*-10. The print data signal SI3 is supplied to the print head 21 through the contact portion 180*a*-10.

Here, the third diagnostic signal DIG3 may be propagated through the wiring 197*a*-8 through which the print data signal 512 is propagated or the wiring 197*a*-10 through which the print data signal SI3 is propagated, and the corresponding contact portions 180*a*-8 and 180*a*-10 may be supplied to the print head 21. Specifically, it is preferable that the third diagnostic signal DIG3 may also serve as wiring through which the print data signal corresponding to the nozzle row from which the black ink is discharged is propagated, or may be supplied to a contact portion common to the wiring. In other words, it is preferable that the wiring through which the third diagnostic signal DIG3 is propagated and the contact portion to which the third diagnostic signal DIG3 is supplied also serve as wiring through which a signal defining the waveform selection of the drive signal COMA and the drive signal COMB corresponding to the nozzle row including the nozzle 651 from which the black liquid is discharged is propagated, or a contact portion to which the signal defining the waveform selection is supplied. Black ink is one of the most widely used inks in the liquid discharge apparatus 1. Therefore, the wiring is in electrically contact with the print head 21 at the common contact portion, also serving as the wiring through which the third diagnostic signal DIG3 is propagated and the wiring through which the print data signal corresponding to the nozzle row from which the black ink is discharged is propagated. Therefore, in the print head 21, even when the number of nozzle rows from which the ink is discharged is different, it is possible to perform the self-diagnosis function of the print head 21. Here, the black ink is not limited to black, and may be matte black or photo black.

The temperature signal TH, which is an analog signal including temperature information of the print head 21, is propagated to the wiring 197*a*-16. The temperature signal TH is supplied to the wiring 197*a*-16 through the contact portion 180*a*-16.

The ground signal GND is propagated through the wiring 197*a*-7, 197*a*-9, 197*a*-11 to 197*a*-13, 197*a*-15, 197*a*-18, 197*a*-20, and 197*a*-22. The ground signal GND is supplied to the print head 21 through the contact portions 180*a*-7, 180*a*-9, 180*a*-11 to 180*a*-13, 180*a*-15, 180*a*-18, 180*a*-20, and 180*a*-22.

As illustrated in FIG. 18, among the wiring through which the ground signal GND is propagated, the wiring 197*a*-22 are provided between the wiring 197*a*-21, 197*a*-17 and 197*a*-14, and the first wiring group 81. In addition, the wiring 197*a*-7 are provided between the wiring 197*a*-21, the wiring 197*a*-17 and the wiring 197*a*-14, and the third wiring group 83. In other words, among the wiring through which the ground signal GND is propagated, the wiring 197*a*-22 are located closer to the first wiring group 81 than the wiring 197*a*-21, 197*a*-17, and 197*a*-14, and the wiring 197*a*-7 is located closer to the third wiring group 83 than the wiring 197*a*-21, 197*a*-17, and 197*a*-14. As a result, the possibility that the drive signals COMA and COMB interfere with the first diagnostic signal DIG1, the second diagnostic signal DIG2, and the third diagnostic signal DIG3 is reduced. Accordingly, the first diagnostic signal DIG1, the second diagnostic signal DIG2, and the third diagnostic signal DIG3 are accurately supplied to the print head 21. Therefore, it is possible to reduce the possibility that the self-diagnosis function of the print head 21 does not normally operate. Here, the wiring 197*a*-22 through which the ground signal GND is propagated is an example of a first ground signal propagation wiring, and the wiring 197*a*-7 is an example of a second ground signal propagation wiring.

In addition, similarly, among the contact portions for supplying the ground signal GND to the print head 21, the contact portion 180*a*-22 is provided between the contact portion 180*a*-21, the contact portion 180*a*-17 and the contact portion 180*a*-14, and the first wiring contact group 91. In addition, the contact portion 180*a*-7 is provided between the contact portion 180*a*-21, the contact portion 180*a*-17 and the contact portion 180*a*-14, and the third wiring contact group 93. In other words, among the contact portions supplying the ground signal GND to the print head 21, the contact portion 180*a*-22 is located closer to the first wiring contact group 91 side than the contact portion 180*a*-21, the contact portion 180*a*-17, and the contact portion 180*a*-14. The contact portion 180*a*-7 is located closer to the third wiring contact group 93 side than the contact portion 180*a*-21, the contact portion 180*a*-17, and the contact portion 180*a*-14. As a result, the possibility that the drive signals COMA and COMB interfere with the first diagnostic signal DIG1, the second diagnostic signal DIG2, and the third diagnostic signal DIG3 is reduced. Accordingly, the first diagnostic signal DIG1, the second diagnostic signal DIG2, and the third diagnostic signal DIG3 are accurately supplied to the print head 21. Therefore, it is possible to reduce the possibility that the self-diagnosis function of the print head 21 does not normally operate. Here, the contact portion 180*a*-22 in which the wiring through which the ground signal GND is propagated is electrically contacted with the print head 21 is an example of a sixth contact portion, and the contact portion 180*a*-7 is an example of a seventh contact portion.

In addition, in the first cable 19*a*, the wiring 197*a*-17 is provided between the wiring 197*a*-21 and the wiring 197*a*-14. In this case, the wiring 197*a*-18 and 197*a*-20 for propagating the ground signal are provided between the wiring 197*a*-21 and the wiring 197*a*-17, and the wiring 197*a*-15 for propagating the ground signal are provided between the wiring 197*a*-17 and the wiring 197*a*-14. That is, the wiring 197*a*-21, 197*a*-17, and 197*a*-14, through which each of the first diagnostic signal DIG1, the second diagnostic signal DIG2, and the third diagnostic signal DIG3 is propagated, are located so as not to be adjacent to each other. Furthermore, wiring through which the ground signal GND is propagated is provided between the wiring 197*a*-21, 197*a*-17, and 197*a*-14, respectively. As a result, the possibility that the first diagnostic signal DIG1, the second diagnostic signal DIG2, and the third diagnostic signal DIG3 interfere with one another is reduced. Accordingly, the first diagnostic signal DIG1, the second diagnostic signal DIG2, and the third diagnostic signal DIG3 are accurately supplied to the print head 21. Therefore, it is possible to reduce the possibility that the self-diagnosis function of the print head 21 does not normally operate. Here, at least one of the wiring 197*a*-18 and 197*a*-20 is an example of a fifth ground signal propagation wiring, and the wiring 197*a*-15 is an example of a sixth ground signal propagation wiring.

In addition, similarly, in the contact portion being electrically contact with the first cable 19*a* and the print head 21, the contact portion 180*a*-17 is provided between the contact portion 180*a*-21 and the contact portion 180*a*-14. In this case, the contact portions 180*a*-18 and 180*a*-20 are provided between the contact portion 180*a*-21 and the contact portion 180*a*-17, and the contact portion 180*a*-15 is provided between the contact portion 180*a*-17 and the contact portion 180*a*-14. That is, the contact portions 180*a*-21, 180*a*-17, and 180*a*-14, in which each of the first diagnostic signal DIG1, the second diagnostic signal DIG2, and the third diagnostic signal DIG3 is supplied to the print head 21, are located so as not to be adjacent to each other. Furthermore, the contact portion in which the ground signal GND is supplied to the print head 21 is provided between the contact portions 180*a*-21, 180*a*-17, and 180*a*-14, respectively. As a result, the possibility that the first diagnostic signal DIG1, the second diagnostic signal DIG2, and the third diagnostic signal DIG3 interfere with one another is reduced. Accordingly, the first diagnostic signal DIG1, the second diagnostic signal DIG2, and the third diagnostic signal DIG3 are accurately supplied to the print head 21. Therefore, it is possible to reduce the possibility that the self-diagnosis function of the print head 21 does not normally operate. Here, at least one of the contact portions 180*a*-18 and 180*a*-20 is an example of a tenth contact portion, and the contact portion 180*a*-15 is an example of an eleventh contact portion.

As described above, the second wiring group 82 includes at least the wiring 197*a*-21 propagating the first diagnostic signal DIG1, and the wiring 197*a*-17 propagating the second diagnostic signal DIG2, and the wiring 197*a*-14 propagating the third diagnostic signal DIG3 for performing the self-diagnosis of the print head 21. Such a second wiring group 82 is configured to include the wiring adjacent to each other in the first cable 19*a*. That is, the second wiring group 82 is a collection of the plurality of wiring including the wiring propagating the first diagnostic signal DIG1, the second diagnostic signal DIG2, and the third diagnostic signal DIG3 which are low voltage signals for performing the self-diagnosis of the print head 21. The plurality of wiring included in the second wiring group 82 are provided adjacent to each other in the first cable 19*a*. The second wiring group 82 may include the plurality of wiring through which low voltage signals for controlling the print head 21 such as the print data signals SI1 to SI3, the change signals CH1 and CH2, the latch signal LAT, and the ground signal GND are propagated and the wiring through which the ground signal GND is propagated.

In addition, similarly, the second wiring contact group 92 includes the contact portion 180*a*-21 in which the wiring 197*a*-21 propagating the first diagnostic signal DIG1 for at least performing self-diagnosis of the print head 21 and the print head 21 are in electrical contact with each other, the contact portion 180*a*-17 in which the wiring 197*a*-17 propagating the second diagnostic signal DIG2 and the print head 21 are in electrical contact with each other, and the contact portion 180*a*-14 in which the wiring 197*a*-14 propagating the third diagnostic signal DIG3 and the print head 21 are in electrical contact with each other. Such a second wiring contact group 92 is configured to include the contact portions adjacent to each other. That is, the second wiring contact group 92 is a collection of the plurality of contact portions for supplying the first diagnostic signal DIG1, the second diagnostic signal DIG2, and the third diagnostic signal DIG3 which are low voltage signals for performing the self-diagnosis of the print head 21 to the print head 21. The plurality of contact portions are provided adjacent to each other. The second wiring contact group 92 may include the plurality of wirings through which the low voltage signals for controlling the print head 21 such as the print data signals SI1 to 513, the change signals CH1 and CH2, the latch signal LAT, and the ground signal GND are propagated, and the contact group for supplying the ground signal GND to the print head 21.

When the first cable 19*a* including the second wiring group 82 configured as described above is attached to the first connector 350 through the second wiring contact group 92, each of the terminals 196*a*-7 to 196*a*-22 of the first cable 19*a* is electrically coupled to each of the terminals 353-7 to 353-22 of the first connector 350 through the contact portions 180*a*-7 to 180*a*-22. As a result, the plurality of signals including the first diagnostic signal DIG1, the second diagnostic signal DIG2 and the third diagnostic signal DIG3 propagated through the wiring 197*a*-7 to 197*a*-22 are supplied to the print head 21. That is, in the print head 21, the terminal 353-21 to which the first diagnostic signal DIG1 is input is an example of a first coupling point, the terminal 353-17 to which the second diagnostic signal DIG2 is input is a second coupling point, and the terminal 353-14 to which the third diagnostic signal DIG3 is input is an example of a third coupling point. In addition, the contact group 97 including the first wiring contact group 91, the second wiring contact group 92, and the third wiring contact group 93 for electrically coupling the first cable 19*a* and the print head 21 is an example of a first contact group.

In addition, in the first cable 19*a*, the second wiring group 82 is provided between the first wiring group 81 and the third wiring group 83. As a result, noise generated outside the first cable 19*a* is shielded by the first wiring group 81 and the third wiring group 83, and the possibility that the noise is superimposed on the second wiring group 82 is reduced. Similarly, in the contact group 97, the second wiring contact group 92 is provided between the first wiring contact group 91 and the third wiring contact group 93. As a result, noise generated in the vicinity of the contact group 97 is shielded by the first wiring contact group 91 and the third wiring contact group 93, and the possibility that the noise is superimposed on the second wiring contact group 92 is reduced. Accordingly, the first diagnostic signal DIG1, the second diagnostic signal DIG2, and the third diagnostic signal DIG3 propagated through the second wiring group 82 and supplied to the print head 21 through the second wiring contact group 92 are accurately supplied to the print head 21. Therefore, it is possible to reduce the possibility that the self-diagnosis function of the print head 21 does not normally operate.

In addition, the first cable 19*a* includes the wiring 197*a*-23 propagating the high voltage signal VHV. The high voltage signal VHV is supplied to the print head 21 through the contact portions 180*a*-23. The wiring 197*a*-23 is located between the first wiring group 81 and the second wiring group 82, and the contact portion 180*a*-23 is located between the first wiring contact group 91 and the second wiring contact group 92. As a result, the possibility that the noise is superimposed on the second wiring group 82 and the second wiring contact group 92 is further reduced. The wiring propagating the high voltage signal VHV may be provided between the second wiring group 82 and the third wiring group 83, and the contact portion supplying the high voltage signal VHV to the print head 21 may be provided between the second wiring contact group 92 and the third wiring contact group 93.

Next, details of the signal propagated through the second cable 19*b* will be described with reference to FIG. 19. FIG. 19 is a table for describing the details of the signal propagated through the second cable 19*b*. As illustrated in FIG. 19, the second cable 19*b* includes a fourth wiring group 84 as an example of a third drive signal wiring group, a fifth wiring group 85 as an example of a second diagnostic signal wiring group, and a sixth wiring group 86 as an example of a fourth drive signal wiring group. The fourth wiring group 84 is in electrical contact with the print head 21 through a fourth wiring contact group 94. In addition, the fifth wiring group 85 is in electrical contact with the print head 21 through a fifth wiring contact group 95. In addition, the sixth wiring group 86 is in electrical contact with the print head 21 through a sixth wiring contact group 96. Here, the fourth wiring contact group 94 in which the fourth wiring group 84 and the print head 21 are in electrical contact with each other is an example of a third drive signal contact group, and the sixth wiring contact group 96 in which the sixth wiring group 86 and the print head 21 are in electrical contact with each other is an example of a fourth drive signal contact group.

The fourth wiring group 84 includes the wiring 197*b*-24 to 197*b*-29. In addition, the fourth wiring contact group 94 includes the contact portions 180*b*-24 to 180*b*-29. The drive signal COMA4 supplied to one end of the piezoelectric element 60 included in the nozzle row L4 is propagated to the wiring 197*b*-29. The drive signal COMA4 is supplied to the print head 21 through the contact portion 180*b*-29. The reference voltage signal CGND4 supplied to the other end of the piezoelectric element 60 included in the nozzle row L4 is propagated to the wiring 197*b*-28. The reference voltage signal CGND4 is supplied to the print head 21 through the contact portion 180*b*-28. The drive signal COMB5 supplied to one end of the piezoelectric element 60 included in the nozzle row L5 is propagated to the wiring 197*b*-27. The drive signal COMB5 is supplied to the print head 21 through the contact portion 180*b*-27. The reference voltage signal CGND5 supplied to the other end of the piezoelectric element 60 included in the nozzle row L5 is propagated to the wiring 197*b*-26. The reference voltage signal CGND5 is supplied to the print head 21 through the contact portion 180*b*-26. The drive signal COMA6 supplied to one end of the piezoelectric element 60 included in the nozzle row L6 is propagated to the wiring 197*b*-25. The drive signal COMA6 is supplied to the print head 21 through the contact portion 180*b*-25. The reference voltage signal CGND6 supplied to the other end of the piezoelectric element 60 included in the nozzle row L6 is propagated to the wiring 197*b*-24. The reference voltage signal CGND6 is supplied to the print head 21 through the contact portion 180*b*-24.

As described above, the fourth wiring group 84 propagates at least one of the drive signal COMA and the drive signal COMB for causing the print head 21 to discharge the ink. The signal of at least one of the drive signal COMA and the drive signal COMB propagated through the fourth wiring group 84 is supplied to the print head 21 through the fourth wiring contact group 94.

Such a fourth wiring group 84 is configured to include the wiring adjacent to each other in the second cable 19*b*. That is, the fourth wiring group 84 is a collection of the plurality of wiring including the wiring propagating at least one of the drive signal COMA and the drive signal COMB, which are high voltage signals for driving the plurality of piezoelectric elements 60 included in the print head 21. The plurality of wiring included in the fourth wiring group 84 are provided adjacent to each other in the second cable 19*b*.

In addition, similarly, the fourth wiring contact group 94 is a collection of the plurality of the contact portions in which the fourth wiring group 84 and the print head 21 are in electrical contact with each other, and for supplying the print head 21 with at least one of the drive signal COMA and the drive signal COMB, which are high voltage signals for driving the plurality of piezoelectric elements 60 included in the print head 21. The plurality of contact portions included in the fourth wiring contact group 94 are provided adjacent to each other in the plurality of contact portions 180 in which the second cable 19*b* and the second connector 360 are in electrical contact with each other.

When the second cable 19*b* including the fourth wiring group 84 configured as described above is attached to the second connector 360 through the fourth wiring contact group 94, each of the terminals 196*b*-24 to 196*b*-29 of the second cable 19*b* is electrically coupled to each of terminals 363-24 to 363-29 of the second connector 360 through the contact portions 180*b*-24 to 180*b*-29. As a result, each of the drive signals COMA4, COMB5, and COMA6 and reference voltage signals CGND4, CGND5, and CGND6 propagated through the wiring 197*b*-24 to 197*b*-29 is supplied to the print head 21.

The sixth wiring group 86 includes the wiring 197*b*-1 to 197*b*-6. In addition, the sixth wiring contact group 96 includes the contact portions 180*b*-1 to 180*b*-6. The drive signal COMB4 supplied to one end of the piezoelectric element 60 included in the nozzle row L4 is propagated to the wiring 197*b*-2. The drive signal COMB4 is supplied to the print head 21 through the contact portion 180*b*-2. The reference voltage signal CGND4 supplied to the other end of the piezoelectric element 60 included in the nozzle row L4 is propagated to the wiring 197*b*-1. The reference voltage signal CGND4 is supplied to the print head 21 through the contact portion 180*b*-1. The drive signal COMA5 supplied to one end of the piezoelectric element 60 included in the nozzle row L5 is propagated to the wiring 197*b*-4. The drive signal COMA5 is supplied to the print head 21 through the contact portion 180*b*-4. The reference voltage signal CGND5 supplied to the other end of the piezoelectric element 60 included in the nozzle row L5 is propagated to the wiring 197*b*-3. The reference voltage signal CGND5 is supplied to the print head 21 through the contact portion 180*b*-3. The drive signal COMB6 supplied to one end of the piezoelectric element 60 included in the nozzle row L6 is propagated to the wiring 197*b*-6. The drive signal COMB6 is supplied to the print head 21 through the contact portion 180*b*-6. The reference voltage signal CGND6 supplied to the other end of the piezoelectric element 60 included in the nozzle row L6 is propagated to the wiring 197*b*-5. The reference voltage signal CGND6 is supplied to the print head 21 through the contact portion 180*b*-5.

As described above, the sixth wiring group 86 propagates at least one of the drive signal COMA and the drive signal COMB for causing the print head 21 to discharge the ink. The signal of at least one of the drive signal COMA and the drive signal COMB propagated through the sixth wiring group 86 is supplied to the print head 21 through the sixth wiring contact group 96.

Such a sixth wiring group 86 is configured to include the wiring adjacent to each other in the second cable 19*b*. That is, the sixth wiring group 86 is a collection of the plurality of wiring including the wiring propagating at least one of the drive signal COMA and the drive signal COMB, which are high voltage signals for driving the plurality of piezoelectric elements 60 included in the print head 21. The plurality of wiring included in the sixth wiring group 86 are provided adjacent to each other in the second cable 19*b*.

In addition, similarly, the sixth wiring contact group 96 is a collection of the plurality of the contact portions in which the sixth wiring group 86 and the print head 21 are in electrical contact with each other, and for supplying the print head 21 with at least one of the drive signal COMA and the drive signal COMB, which are high voltage signals for driving the plurality of piezoelectric elements 60 included in the print head 21. The plurality of contact portions included in the sixth wiring contact group 96 are provided adjacent to each other in the plurality of contact portions 180 in which the second cable 19*b* and the second connector 360 are in electrical contact with each other.

When the second cable 19*b* including the sixth wiring group 86 configured as described above is attached to the second connector 360 through the sixth wiring contact group 96, each of the terminals 196*b*-1 to 196*b*-6 of the second cable 19*b* is electrically coupled to each of terminals 363-1 to 363-6 of the second connector 360 through the contact portions 180*b*-1 to 180*b*-6. As a result, each of the drive signals COMB4, COMA5, and COMB6 and reference voltage signals CGND4, CGND5, and CGND6 propagated through the wiring 197*b*-1 to 197*b*-6 are supplied to the print head 21.

The fifth wiring group 85 includes the wiring 197*b*-7 to 197*b*-23. In addition, the fifth wiring contact group 95 includes the contact portions 180*b*-7 to 180*b*-23. Although the clock signal SCK and a fourth diagnostic signal DIG4 may be propagated through different wiring, as illustrated in FIG. 19, it is preferable that the clock signal SCK for controlling the timing of various signals supplied to the print head 21 and the fourth diagnostic signal DIG4 for performing self-diagnosis of the print head 21 are propagated through the common wiring 197*b*-10. In other words, it is preferable that the wiring 197*b*-10 also serves as wiring for propagating the fourth diagnostic signal DIG4 and wiring for propagating the clock signal SCK. In the non-printing state, when the print data signal SI is not supplied, the clock signal SCK is not propagated through the wiring 197*b*-10. On the other hand, since the self-diagnosis of the print head 21 is performed in the non-printing state, the fourth diagnostic signal DIG4 is propagated through the wiring 197*b*-10 in the non-printing state. Therefore, the clock signal SCK and the fourth diagnostic signal DIG4 can be propagated through the common wiring 197*b*-10. As a result, the number of wiring included in the second cable 19*b* can be reduced.

In addition, similarly, as illustrated in FIG. 19, it is preferable that the wiring for propagating the clock signal SCK, and the wiring for propagating the fourth diagnostic signal DIG4 for performing self-diagnosis of the print head 21 are in electrical contact with the common contact portion 180*b*-10. In other words, it is preferable that the contact portion 180*b*-10 also serves as a contact portion in electrical contact with the wiring for propagating the fourth diagnostic signal DIG4 and a contact portion in electrical contact with the wiring for propagating the clock signal SCK. In the non-printing state, the clock signal SCK is not propagated through the wiring 197*b*-10. Therefore, the clock signal SCK is not supplied to the contact portion 180*b*-10. On the other hand, since the self-diagnosis of the print head 21 is performed in the non-printing state, the fourth diagnostic signal DIG4 is supplied to the contact portion 180*b*-10 in the non-printing state. Therefore, the clock signal SCK and the fourth diagnostic signal DIG4 can be supplied to the print head 21 through the common contact portion 180*b*-10. As a result, the number of contact portions in which the second cable 19*b* and the print head 21 are in electrical contact with each other can be reduced. Accordingly, the number of wiring included in the second cable 19*b* and the number of terminals of the second connector 360 can be reduced.

Furthermore, the clock signal SCK is an important signal for controlling the timing of various signals for controlling the discharge of ink in the liquid discharge apparatus 1, and when coupling failure occurs in the wiring through which the clock signal SCK is propagated and the contact portion, there is a possibility that the ink discharge accuracy may be deteriorated. The fourth diagnostic signal DIG4 and the clock signal SCK are propagated through the common wiring 197*b*-10 and are supplied to the print head 21 through the common contact portion 180*b*-10. Therefore, based on the result of the self-diagnosis of the print head 21, the coupling state of the wiring 197*b*-10 to which the clock signal SCK is propagated and the contact state of the contact portion 180*b*-10 can be confirmed. That is, by performing self-diagnosis of the print head 21 by the fourth diagnostic signal DIG4, the possibility that the ink discharge accuracy of the liquid discharge apparatus 1 may be deteriorated can be reduced. The wiring 197*b*-10 through which the fourth diagnostic signal DIG4 is propagated is an example of a fourth diagnostic signal propagation wiring, and the contact portion 180*b*-10 is an example of a fourth contact portion.

Although the abnormal signal XHOT and the fifth diagnostic signal DIG5 may be propagated through different wiring, as illustrated in FIG. 19, it is preferable that the abnormal signal XHOT and the fifth diagnostic signal DIG5 for performing self-diagnosis of the print head 21 are propagated through the common wiring 197*b*-16. In other words, it is preferable that the wiring 197*b*-16 also serves as wiring for propagating the fifth diagnostic signal DIG5 and wiring for propagating the abnormal signal XHOT. The abnormal signal XHOT is output as an H level or L level signal depending on whether or not a temperature abnormality occurs in the print head 21. In other words, the abnormal signal XHOT is a signal indicating the presence or absence of the temperature abnormality of the print head 21 in the printing state. Therefore, by propagating the abnormal signal XHOT for determining the state of the print head 21 in the printing state and the fifth diagnostic signal DIG5 for determining the state of the print head 21 by the self-diagnosis in the non-printing state through the common wiring 197*b*-16, the processing in the control mechanism 10 can be shared. As a result, it is possible to simplify the control of the liquid discharge apparatus 1. In addition, by propagating the abnormal signal XHOT and the fifth diagnostic signal DIG5 through the common wiring 197*b*-16, the number of wiring included in the second cable 19*b* can be reduced.

In addition, similarly, it is preferable that the wiring for propagating the abnormal signal XHOT and the wiring for propagating the fifth diagnostic signal DIG5 indicating the diagnosis result of the self-diagnosis of the print head 21 are in electrical contact with each other at the common contact portion 180*b*-16. In other words, it is preferable that the contact portion 180*b*-16 also serves as the contact portion in electrical contact with the wiring for propagating the fifth diagnostic signal DIG5 and the contact portion in electrical contact with the wiring for propagating the abnormal signal XHOT. The abnormal signal XHOT is output as an H level or L level signal depending on whether or not a temperature abnormality occurs in the print head 21. In other words, the abnormal signal XHOT is a signal indicating the presence or absence of the temperature abnormality of the print head 21 in the printing state. Therefore, by supplying the abnormal signal XHOT for determining the state of the print head 21 in the printing state and the fifth diagnostic signal DIG5 for determining the state of the print head 21 by the self-diagnosis in the non-printing state to the common contact portion 180*b*-16, the processing in the control mechanism 10 can be shared. As a result, it is possible to simplify the control of the liquid discharge apparatus 1. In addition, by supplying the abnormal signal XHOT and the fifth diagnostic signal DIG5 to the common contact portion 180*b*-16, the number of wiring included in the second cable 19*b* and the number of terminals included in the second connector 360 can be reduced.

Furthermore, the abnormal signal XHOT is an important signal indicating whether or not the print head 21 is abnormal in the liquid discharge apparatus 1, and when the coupling failure occurs in the wiring through which the abnormal signal XHOT is propagated and the contact portion, there is a possibility that the control mechanism 10 may erroneously detect that the print head 21 has an abnormality. The fifth diagnostic signal DIG5 and the abnormal signal XHOT are propagated through the common wiring 197*b*-16 and supplied from the print head 21 through the common contact portion 180*b*-16. Therefore, based on the result of the self-diagnosis of the print head 21, the coupling state of the wiring 197*b*-16 to which the abnormal signal XHOT is propagated and the contact state of the contact portion 180*b*-16 can be confirmed. Therefore, based on the diagnosis result of the fifth diagnostic signal DIG5, the possibility that the abnormal signal XHOT is erroneously detected can be reduced. The wiring 197*b*-16 through which the fifth diagnostic signal DIG5 is propagated is an example of a fifth diagnostic signal propagation wiring, and the contact portion 180*b*-16 is an example of a fifth contact portion.

The print data signal SI4 defining the waveform selection of the drive signals COMA4 and COMB4 supplied to the nozzle row L4 is propagated to the wiring 197*b*-8. The print data signal SI4 is supplied to the print head 21 through the contact portion 180*b*-8. In addition, the print data signal SI5 defining the waveform selection of the drive signals COMA5 and COMB5 supplied to the nozzle row L5 is propagated to the wiring 197*b*-17. The print data signal SI5 is supplied to the print head 21 through the contact portion 180*b*-17. In addition, the print data signal SI6 defining the waveform selection of the drive signals COMA6 and COMB6 supplied to the nozzle row L6 is propagated to the wiring 197*b*-21. The print data signal SI6 is supplied to the print head 21 through the contact portion 180*b*-21.

In the non-printing state, either of the drive signal COMA or the drive signal COMB is forcibly selected to the wiring 197*b*-12, and the N-charge signal NCHG to be output as the drive signal VOUT is propagated. The N-charge signal NCHG is supplied to the print head 21 through the contact portion 180*b*-12.

The ground signal GND is propagated to the wiring 197*b*-7, 197*b*-9, 197*b*-11, 197*b*-14, 197*b*-15, 197*b*-18 to 197*b*-20, and 197*b*-22. The ground signal GND is supplied to the print head 21 through the contact portions 180*b*-7, 180*b*-9, 180*b*-11, 180*b*-14, 180*b*-15, 180*b*-18 to 180*b*-20, 180*b*-22.

Among the wiring through which the ground signal GND is propagated, the wiring 197*b*-22 are provided between the wiring 197*b*-10 and the wiring 197*b*-16, and the fourth wiring group 84. In addition, the wiring 197*b*-7 is provided between the wiring 197*b*-10 and the wiring 197*b*-16, and the sixth wiring group 86. In other words, the wiring 197*b*-22 is located closer to the fourth wiring group 84 than the wiring 197*b*-10 and the wiring 197*b*-16, and the wiring 197*b*-7 is located closer to the sixth wiring group 86 than the wiring 197*b*-10 and the wiring 197*b*-16. As a result, interference of the drive signals COMA and COMB with the fourth diagnostic signal DIG4 and the fifth diagnostic signal DIG5 can be reduced. Accordingly, the fourth diagnostic signal DIG4 and the fifth diagnostic signal DIG5 are accurately supplied to the print head 21. Therefore, it is possible to reduce the possibility that the self-diagnosis function of the print head 21 does not normally operate. Here, the wiring 197*b*-22 through which the ground signal GND is propagated is an example of a third ground signal propagation wiring, and the wiring 197*b*-7 is an example of a fourth ground signal propagation wiring.

In addition, similarly, among the contact portions for supplying the ground signal GND to the print head 21, the contact portion 180*b*-22 are provided between the contact portion 180*b*-10 and the contact portion 180*b*-16, and the fourth wiring contact group 94. In addition, the contact portion 180*b*-7 is provided between the contact portion 180*b*-10 and the contact portion 180*b*-16, and the sixth wiring contact group 96. In other words, the contact portion 180*b*-22 is located closer to the fourth wiring contact group 94 than the contact portion 180*b*-10 and the contact portion 180*b*-16, and the contact portion 180*b*-7 is located closer to the sixth wiring contact group 96 than the contact portion 180*b*-10 and the contact portion 180*b*-16. As a result, interference of the drive signals COMA and COMB with the fourth diagnostic signal DIG4 and the fifth diagnostic signal DIG5 can be reduced. Accordingly, the fourth diagnostic signal DIG4 and the fifth diagnostic signal DIG5 are accurately supplied to the print head 21. Therefore, it is possible to reduce the possibility that the self-diagnosis function of the print head 21 does not normally operate. Here, the contact portion 180*b*-22 in which the wiring through which the ground signal GND is propagated is in electrical contact with the print head 21 is an example of an eighth contact portion, and the contact portion 180*b*-7 is an example of a ninth contact portion.

In addition, in the second cable 19*b*, the wiring 197*b*-11, 197*b*-14, and 197*b*-15 are provided between the wiring 197*b*-10 and the wiring 197*b*-16. That is, the wiring 197*b*-10 and 197*b*-16 through which each of the fourth diagnostic signal DIG4 and the fifth diagnostic signal DIG5 is propagated are located so as not to be adjacent to each other. Furthermore, the wiring for propagating the ground signal GND is provided between the wiring 197 *b*-10 and 197 *b*-16. As a result, it is reduced that the fourth diagnostic signal DIG4 and the fifth diagnostic signal DIG5 interfere with each other. Accordingly, the fourth diagnostic signal DIG4 and the fifth diagnostic signal DIG5 are accurately supplied to the print head 21. Therefore, it is possible to reduce the possibility that the self-diagnosis function of the print head 21 does not normally operate. Here, at least one of the wiring 197*b*-11, 197*b*-14, and 197*b*-15 is an example of a seventh ground signal propagation wiring.

In addition, similarly, in the second cable 19*b*, the contact portions 180*b*-11, 180*b*-14, and 180*b*-15 are provided between the contact portion 180*b*-10 and the contact portion 180*b*-16. That is, the contact portions 180*b*-10 and 180*b*-16, in which each of the fourth diagnostic signal DIG4 and the fifth diagnostic signal DIG5 is supplied to the print head 21, are located so as not to be adjacent to each other. Furthermore, the contact portion in which the ground signal GND is supplied to the print head 21 is provided between the contact portions 180*b*-10 and 180*b*-16. As a result, it is reduced that the fourth diagnostic signal DIG4 and the fifth diagnostic signal DIG5 interfere with each other. Accordingly, the fourth diagnostic signal DIG4 and the fifth diagnostic signal DIG5 are accurately supplied to the print head 21. Therefore, it is possible to reduce the possibility that the self-diagnosis function of the print head 21 does not normally operate. Here, at least one of the contact portions 180*b*-11, 180*b*-14, and 180*b*-15 is an example of a twelfth contact portion.

As described above, the fifth wiring group 85 includes at least the wiring 197*b*-10 propagating the fourth diagnostic signal DIG4 and the wiring 197*b*-16 propagating the fifth diagnostic signal DIG5 for performing the self-diagnosis of the print head 21. Such a fifth wiring group 85 is configured to include the wiring adjacent to each other in the second cable 19*b*. That is, the fifth wiring group 85 a collection of the plurality of wiring including the wiring propagating the fourth diagnostic signal DIG4 and the fifth diagnostic signal DIG5 which are low voltage signals for at least performing the self-diagnosis of the print head 21. The plurality of wiring included in the fifth wiring group 85 are provided adjacent to each other in the second cable 19*b*. The fifth wiring group 85 may include a plurality of wiring propagating the print data signals SI4 to SI6, the abnormal signal XHOT, the ground signal GND, and the like.

In addition, similarly, the fifth wiring contact group 95 is a contact portion in which the wiring 197*b*-10 propagating the fourth diagnostic signal DIG4 for at least self-diagnosis of the print head 21 makes electrical contact with the print head 21. 180*b*-10, and a contact portion 180*b*-16 in which the wiring 197*b*-16 for propagating the fifth diagnostic signal DIG5 and the print head 21 are in electrical contact with each other. Such a fifth wiring contact group 95 is composed of contact portions adjacent to each other. That is, the fifth wiring contact group 95 is a collection of the plurality of contact portions for supplying the fourth diagnostic signal DIG4 and the fifth diagnostic signal DIG5, which are low voltage signals for the self-diagnosis of the print head 21, to the print head 21. The plurality of contact portions are provided adjacent to each other. The fifth wiring contact group 95 may include the plurality of wiring propagating low voltage signals for controlling the print head 21 such as the print data signals SI4 to SI6, the abnormal signal XHOT, and the ground signal GND are propagated, and the contact group for supplying the ground signals GND to the head 21.

When the second cable 19*b* including the fifth wiring group 85 configured as described above is attached to the second connector 360 through the fifth wiring contact group 95, each of the terminals 196*b*-7 to 196*b*-23 of the second cable 19*b* is electrically coupled to each of the terminals 363-7 to 363-23 of the second connector 360 through the contact portions 180*b*-7 to 180*b*-23. As a result, the plurality of signals including the fourth diagnostic signal DIG4 and the fifth diagnostic signal DIG5 propagated through the wiring 197*b*-7 to 197*b*-23 are supplied to the print head 21. That is, in the print head 21, the terminal 363-10 to which the fourth diagnostic signal DIG4 is supplied is an example of a fourth coupling point, and the terminal 363-16 to which the fifth diagnostic signal DIG5 is supplied is an example of a fifth coupling point. In addition, the contact group 98 including the fourth wiring contact group 94 and the fifth wiring contact group 95 for electrically coupling the second cable 19*b* and the print head 21 is an example of a second contact group.

In addition, in the second cable 19*b*, the fifth wiring group 85 is provided between the fourth wiring group 84 and the sixth wiring group 86. As a result, noise generated outside the second cable 19*b* is shielded by the fourth wiring group 84 and the sixth wiring group 86, and the possibility that the noise is superimposed on the fifth wiring group 85 is reduced. Similarly, in the contact group 98, the fifth wiring contact group 95 is provided between the fourth wiring contact group 94 and the sixth wiring contact group 96. As a result, noise generated in the vicinity of the contact group 98 is shielded by the fourth wiring contact group 94 and the sixth wiring contact group 96, and the possibility that the noise is superimposed on the fifth wiring contact group 95 is reduced. Therefore, the fourth diagnostic signal DIG4 and the fifth diagnostic signal DIG5 propagated through the fifth wiring group 85 and supplied to the print head 21 through the fifth wiring contact group 95 are accurately supplied to the print head 21. Therefore, it is possible to reduce the possibility that the self-diagnosis function of the print head 21 does not normally operate.

Furthermore, in the present embodiment, the first diagnostic signal DIG1, the second diagnostic signal DIG2, and the third diagnostic signal DIG3 output from the print head control circuit 15 are propagated through the first cable 19*a* and supplied to the print head 21 through the contact group 97, and the fourth diagnostic signal DIG4 and the fifth diagnostic signal DIG5 are propagated through the second cable 19*b* and supplied to the print head 21 through the contact group 98. That is, among the plurality of diagnostic signals for self-diagnosis of the print head 21, a portion is propagated through the first cable 19*a*, and a different portion is propagated through the second cable 19*b*. Therefore, even when a coupling failure occurs in the first cable 19*a* or the second cable 19*b*, or even when a contact failure occurs in the contact group 97 or the contact group 98, it is possible to detect the coupling failure.

8. Action and Effect

As described above, in the print head control circuit 15 provided in the liquid discharge apparatus 1 according to the present embodiment, in the first cable 19*a*, the wiring through which the first diagnostic signal DIG1, the second diagnostic signal DIG2, and the third diagnostic signal DIG3 for controlling the self-diagnosis of the print head 21 are propagated are collectively provided as the second wiring group 82. That is, the wiring through which the first diagnostic signal DIG1, the second diagnostic signal DIG2, and the third diagnostic signal DIG3 are propagated are not distributed in the first cable 19*a*. In addition, in the liquid discharge apparatus 1 according to the present embodiment, the first diagnostic signal DIG1, the second diagnostic signal DIG2, and the third diagnostic signal DIG3 for controlling the self-diagnosis of the print head 21 propagated through the first cable 19*a* are collectively provided as the second wiring contact group 92. That is, the contact portions in which the first diagnostic signal DIG1, the second diagnostic signal DIG2, and the third diagnostic signal DIG3 are supplied to the print head 21 are not distributed in the contact group 97. Accordingly, the possibility that the noise is superimposed on the first diagnostic signal DIG1, the second diagnostic signal DIG2, and the third diagnostic signal DIG3 is reduced.

In addition, in the second cable 19*b*, the wiring through which the fourth diagnostic signal DIG4 and the fifth diagnostic signal DIG5 for controlling the self-diagnosis of the print head 21 are propagated are collectively provided as the fifth wiring group 85. That is, the wiring through which the fourth diagnostic signal DIG4 and the fifth diagnostic signal DIG5 are propagated are not distributed in the second cable 19*b*. Similarly, the fourth diagnostic signal DIG4 and the fifth diagnostic signal DIG5 for controlling the self-diagnosis of the print head 21 propagated through the second cable 19*b* are collectively provided as the fifth wiring contact group 95. That is, the contact portion in which the fourth diagnostic signal DIG4 and the fifth diagnostic signal DIG5 are supplied to the print head 21 are not distributed in the contact group 98. Accordingly, the possibility that the noise is superimposed on the fourth diagnostic signal DIG4 and the fifth diagnostic signal DIG5 is reduced.

As described above, even when there is a possibility that the noise is superimposed on each of the first cable 19*a* and the second cable 19*b* through which the diagnostic signal is propagated, it is possible to take measures against the noise. Therefore, the print head control circuit 15 can accurately propagate the first diagnostic signal DIG1, the second diagnostic signal DIG2, the third diagnostic signal DIG5, the fourth diagnostic signal DIG4, and the fifth diagnostic signal DIG5 to the print head 21. Therefore, the possibility that the self-diagnosis function of the print head 21 does not normally operate can be reduced.

In addition, in the print head control circuit 15 provided in the liquid discharge apparatus 1 according to the present embodiment, the second wiring group 82 including the wiring through which the first diagnostic signal DIG1, the second diagnostic signal DIG2, and the third diagnostic signal DIG3 are propagated is provided between the first wiring group 81 and the third wiring group 83 including a plurality of wiring through which the drive signals COMA and COMB are propagated. In addition, similarly, in the liquid discharge apparatus 1, the second wiring contact group 92 in which the second wiring group 82 including the wiring through which the first diagnostic signal DIG1, the second diagnostic signal DIG2, and the third diagnostic signal DIG3 are propagated is electrical contact with the print head 21 is provided between the first wiring contact group 91 in which the first wiring group 81 including the plurality of wiring through which the drive signals COMA and COMB are propagated is electrical contact with the print head 21, and the third wiring contact group 93 in which the third wiring group 83 including the plurality of wiring through which the drive signals COMA and COMB are propagated is in electrical contact with the print head 21. As a result, the possibility that the disturbance noise is superimposed on the second wiring group 82 is reduced.

In addition, the fifth wiring group 85 including the wiring through which the fourth diagnostic signal DIG4 and the fifth diagnostic signal DIG5 are propagated is provided between the fourth wiring group 84 and the sixth wiring group 86 including the plurality of wiring through which the plurality of drive signals COM are propagated. Similarly, the fifth wiring contact group 95 in which the fifth wiring group 85 including the wiring through which the fourth diagnostic signal DIG4 and the fifth diagnostic signal DIG5 are propagated is in electrical contact with the print head 21 is provided between the fourth wiring contact group 94 in which the fourth wiring group 84 including the plurality of wiring through which the plurality of drive signals COM are propagated is in electrical contact with the print head 21 and the sixth wiring contact group 96 in which the sixth wiring group 86 including the plurality of wiring through which the plurality of drive signals COM are propagated in electrical contact with the print head 21. As a result, the possibility that the disturbance noise is superimposed on the fifth wiring group 85 can be reduced.

As described above, it is possible to reduce the possibility that the disturbance noise is superimposed on the second wiring group 82 for propagating the first diagnostic signal DIG1, the second diagnostic signal DIG2, and the third diagnostic signal DIG3, and the fifth wiring group 85 propagating the fourth diagnostic signal DIG4 and the fifth diagnostic signal DIG5. It is possible to reduce the possibility that the disturbance noise is superimposed on the second wiring contact group 92 for supplying the first diagnostic signal DIG1, the second diagnostic signal DIG2 and the third diagnostic signal DIG3 to the print head 21, and the fifth wiring contact group 95 for supplying the fourth diagnostic signal DIG4 and the fifth diagnostic signal DIG5 to the print head 21. Therefore, it is possible to accurately propagate the first diagnostic signal DIG1, the second diagnostic signal DIG2, the third diagnostic signal DIG3, the fourth diagnostic signal DIG4, and the fifth diagnostic signal DIG5 to print head 21. Therefore, it is possible to reduce the possibility that the self-diagnosis function of the print head 21 does not normally operate.

What is claimed is:

1. A print head control circuit controlling an operation of a print head having a function of performing self-diagnosis in accordance with signals input from a first coupling point, a second coupling point, a third coupling point, a fourth coupling point, and a fifth coupling point, the circuit comprising:

a first cable including a first drive signal wiring group, a second drive signal wiring group, and a first diagnostic signal wiring group;

a second cable including a third drive signal wiring group, a fourth drive signal wiring group, and a second diagnostic signal wiring group;

a diagnostic signal output circuit outputting a first diagnostic signal, a second diagnostic signal, a third diagnostic signal, and a fourth diagnostic signal; and a drive signal output circuit outputting a first drive signal and a second drive signal that cause the print head to discharge liquid, wherein the first diagnostic signal wiring group includes first diagnostic signal propagation wiring that propagates the first diagnostic signal input to the first coupling point, second diagnostic signal propagation wiring that propagates the second diagnostic signal input to the second coupling point, and third diagnostic signal propagation wiring that propagates the third diagnostic signal input to the third coupling point, the second diagnostic signal wiring group includes fourth diagnostic signal propagation wiring that propagates the fourth diagnostic signal input to the fourth coupling point, and fifth diagnostic signal propagation wiring that propagates a fifth diagnostic signal input to the fifth coupling point, the first drive signal wiring group propagates at least one of the first drive signal and the second drive signal, the second drive signal wiring group propagates at least one of the first drive signal and the second drive signal, the third drive signal wiring group propagates at least one of the first drive signal and the second drive signal, the fourth drive signal wiring group propagates at least one of the first drive signal and the second drive signal, in the first cable, the first diagnostic signal wiring group is provided between the first drive signal wiring group and the second drive signal wiring group, and in the second cable, the second diagnostic signal wiring group is provided between the third drive signal wiring group and the fourth drive signal wiring group.

2. The print head control circuit according to claim 1, wherein the first drive signal is a signal that causes the print head to discharge a first amount of liquid, the second drive signal is a signal that causes the print head to discharge an amount of liquid different from the first amount, the first drive signal wiring group includes a first drive signal propagation wiring that propagates the first drive signal, and the second drive signal wiring group includes a second drive signal propagation wiring that propagates the second drive signal.

3. The print head control circuit according to claim 1, wherein the first diagnostic signal propagation wiring also serves as wiring that propagates a signal defining a discharge timing.

4. The print head control circuit according to claim 1, wherein the second diagnostic signal propagation wiring also serves as wiring that propagates a signal defining a waveform switching timing of at least one of the first drive signal and the second drive signal.

5. The print head control circuit according to claim 1, wherein the third diagnostic signal propagation wiring also serves as wiring that propagates a signal defining selection of waveforms of the first drive signal and the second drive signal.

6. The print head control circuit according to claim 5, wherein the print head includes a nozzle from which a black liquid is discharged, and the first drive signal and the second drive signal are signals that cause the nozzle to discharge the black liquid.

7. The print head control circuit according to claim 1, wherein the fourth diagnostic signal propagation wiring also serves as wiring that propagates a clock signal.

8. The print head control circuit according to claim 1, wherein the fifth diagnostic signal propagation wiring also serves as wiring that propagates a signal indicating presence or absence of temperature abnormality of the print head.

9. The print head control circuit according to claim 1, wherein the first diagnostic signal wiring group includes a first ground signal propagation wiring and a second ground signal propagation wiring that propagate a signal of ground potential, the first ground signal propagation wiring is provided between the first diagnostic signal propagation wiring, the second diagnostic signal propagation wiring, and the third diagnostic signal propagation wiring, and the first drive signal wiring group, and the second ground signal propagation wiring is provided between the first diagnostic signal propagation wiring, the second diagnostic signal propagation wiring, and the third diagnostic signal propagation wiring, and the second drive signal wiring group.

10. The print head control circuit according to claim 1, wherein the second diagnostic signal wiring group includes a third ground signal propagation wiring and a fourth ground signal propagation wiring that propagate a signal of ground potential, the third ground signal propagation wiring is provided between the fourth diagnostic signal propagation wiring and the fifth diagnostic signal propagation wiring, and the third drive signal wiring group, and the fourth ground signal propagation wiring is provided between the fourth diagnostic signal propagation wiring and the fifth diagnostic signal propagation wiring, and the fourth drive signal wiring group.

11. The print head control circuit according to claim 1, wherein the first diagnostic signal wiring group includes a fifth ground signal propagation wiring and a sixth ground signal propagation wiring that propagate a signal of ground potential, the second diagnostic signal propagation wiring is provided between the first diagnostic signal propagation wiring and the third diagnostic signal propagation wiring, the fifth ground signal propagation wiring is provided between the first diagnostic signal propagation wiring and the second diagnostic signal propagation wiring, and the sixth ground signal propagation wiring is provided between the second diagnostic signal propagation wiring and the third diagnostic signal propagation wiring.

12. The print head control circuit according to claim 1, wherein the second diagnostic signal wiring group includes a seventh ground signal propagation wiring that propagates a signal of ground potential, and the seventh ground signal propagation wiring is provided between the fourth diagnostic signal propagation wiring and the fifth diagnostic signal propagation wiring.

13. A liquid discharge apparatus comprising:

a print head having a function of performing self-diagnosis in accordance with signals input from a first coupling point, a second coupling point, a third coupling point, a fourth coupling point, and a fifth coupling point; and a print head control circuit controlling an operation of the print head, wherein the print head control circuit includes a first cable having a first drive signal wiring group, a second drive signal wiring group, and a first diagnostic signal wiring group, a second cable having a third drive signal wiring group, a fourth drive signal wiring group, and a second diagnostic signal wiring group, a diagnostic signal output circuit outputting a first diagnostic signal, a second diagnostic signal, a third diagnostic signal, and a fourth diagnostic signal, and a drive signal output circuit outputting a first drive signal and a second drive signal that cause the print head to discharge liquid, the first diagnostic signal wiring group includes first diagnostic signal propagation wiring that propagates the first diagnostic signal input to the first coupling point, second diagnostic signal propagation wiring that propagates the second diagnostic signal input to the second coupling point, and third diagnostic signal propagation wiring that propagates the third diagnostic signal input to the third coupling point, the second diagnostic signal wiring group includes a fourth diagnostic signal propagation wiring that propagates the fourth diagnostic signal input to the fourth coupling point, and a fifth diagnostic signal propagation wiring that propagates a fifth diagnostic signal input to the fifth coupling point, the first drive signal wiring group propagates at least one of the first drive signal and the second drive signal, the second drive signal wiring group propagates at least one of the first drive signal and the second drive signal, the third drive signal wiring group propagates at least one of the first drive signal and the second drive signal, the fourth drive signal wiring group propagates at least one of the first drive signal and the second drive signal, in a first contact group in which the first cable and the print head are in electrical contact with each other, a first contact portion in which the first coupling point and the first diagnostic signal propagation wiring are in electrical contact with each other, a second contact portion in which the second coupling point and the second diagnostic signal propagation wiring are in electrical contact with each other, and a third contact portion in which the third coupling point and the third diagnostic signal propagation wiring are in electrical contact with each other are located between a first drive signal contact group in which the first drive signal wiring group is in electrical contact with the print head, and a second drive signal contact group in which the second drive signal wiring group is in electrical contact with the print head, and in a second contact group in which the second cable and the print head are in electrical contact with each other, a fourth contact portion in which the fourth coupling point and the fourth diagnostic signal propagation wiring are in electrical contact with each other, and a fifth contact portion in which the fifth coupling point and the fifth diagnostic signal propagation wiring are in electrical contact with each other are located between a third drive signal contact group in which the third drive signal wiring group is in electrical contact with the print head, and a fourth drive signal contact group in which the fourth drive signal wiring group is in electrical contact with the print head.

14. The liquid discharge apparatus according to claim 13, wherein the first drive signal is a signal that causes the print head to discharge a first amount of liquid, the second drive signal is a signal that causes the print head to discharge an amount of liquid different from the first amount, the first drive signal wiring group includes a first drive signal propagation wiring that propagates the first drive signal, and the second drive signal wiring group includes a second drive signal propagation wiring that propagates the second drive signal.

15. The liquid discharge apparatus according to claim 13, wherein the first contact portion is in electrical contact with wiring that propagates a signal defining a discharge timing.

16. The liquid discharge apparatus according to claim 13, wherein the second contact portion is in electrical contact with wiring that propagates a signal defining a waveform switching timing of at least one of the first drive signal and the second drive signal.

17. The liquid discharge apparatus according to claim 13, wherein the third contact portion is in electrical contact with wiring that propagates a signal defining selection of waveforms of the first drive signal and the second drive signal.

18. The liquid discharge apparatus according to claim 17, wherein the print head includes a nozzle from which a black liquid is discharged, and the first drive signal and the second drive signal are signals that cause the nozzle to discharge the black liquid.

19. The liquid discharge apparatus according to claim 13, wherein the fourth contact portion is in electrical contact with wiring that propagates a clock signal.

20. The liquid discharge apparatus according to claim 13, wherein the fifth contact portion is in electrical contact with wiring that propagates a signal indicating presence or absence of temperature abnormality of the print head.

21. The liquid discharge apparatus according to claim 13, wherein the first diagnostic signal wiring group includes a first ground signal propagation wiring and a second ground signal propagation wiring that propagate a signal of ground potential, and in the first contact group, a sixth contact portion in which the first ground signal propagation wiring and the print head are in electrical contact with each other is located between the first contact portion, the second contact portion, and the third contact portion, and the first drive signal contact group, and a seventh contact portion in which the second ground signal propagation wiring and the print head are in electrical contact with each other is located between the first contact portion, the second contact portion, and the third contact portion, and the second drive signal contact group.

22. The liquid discharge apparatus according to claim 13, wherein the second diagnostic signal wiring group includes a third ground signal propagation wiring and a fourth ground signal propagation wiring that propagate a signal of ground potential, and in the second contact group, an eighth contact portion in which the third ground signal propagation wiring and the print head are in electrical contact with each other is located between the fourth contact portion and the fifth contact portion, and the third drive signal contact group, and a ninth contact portion in which the fourth ground signal propagation wiring and the print head are in electrical contact with each other is located between the fourth contact portion and the fifth contact portion, and the fourth drive signal contact group.

23. The liquid discharge apparatus according to claim 13, wherein the first diagnostic signal wiring group includes a fifth ground signal propagation wiring and a sixth ground signal propagation wiring that propagate a signal of ground potential, and in the first contact group, the second contact portion is located between the first contact portion and the third contact portion, a tenth contact portion in which the fifth ground signal propagation wiring and the print head are in electrical contact with each other is located between the first contact portion and the second contact portion, and an eleventh contact portion in which the sixth ground signal propagation wiring and the print head are in electrical contact with each other is located between the second contact portion and the third contact portion.

24. The liquid discharge apparatus according to claim 13, wherein the second diagnostic signal wiring group includes a seventh ground signal propagation wiring that propagates a signal of ground potential, and in the second contact group, a twelfth contact portion in which the seventh ground signal propagation wiring and the print head are in electrical contact with each other is located between the fourth contact portion and the fifth contact portion.

* * * * *